US011565524B2

(12) United States Patent
Aimono et al.

(10) Patent No.: US 11,565,524 B2
(45) Date of Patent: Jan. 31, 2023

(54) LIQUID EJECTING HEAD AND LIQUID EJECTING APPARATUS

(71) Applicant: SEIKO EPSON CORPORATION, Tokyo (JP)

(72) Inventors: Takanori Aimono, Matsumoto (JP); Eiju Hirai, Azumino (JP); Masao Nakayama, Shiojiri (JP); Junichi Karasawa, Shimosuwa-machi (JP); Yoshihiro Hokari, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/169,672

(22) Filed: Feb. 8, 2021

(65) Prior Publication Data

US 2021/0245509 A1 Aug. 12, 2021

(30) Foreign Application Priority Data

Feb. 10, 2020 (JP) ..... JP2020-020368

(51) Int. Cl.
*B41J 2/14* (2006.01)

(52) U.S. Cl.
CPC ..... *B41J 2/14233* (2013.01)

(58) Field of Classification Search
None
See application file for complete search history.

(56) References Cited

U.S. PATENT DOCUMENTS

2014/0071207 A1* 3/2014 Nakatani ..... B41J 2/1629 347/70
2019/0193401 A1 6/2019 Kasahara et al.

FOREIGN PATENT DOCUMENTS

EP 1116591 7/2001
JP 2019-111738 7/2019

* cited by examiner

*Primary Examiner* — Erica S Lin
(74) *Attorney, Agent, or Firm* — Workman Nydegger

(57) ABSTRACT

A plurality of wall surfaces that constitute inner walls of the pressure compartment includes a surface of the recessed portion and the first wall surface, and an angle formed by the first surface and the first wall surface is greater than 90° and less than 180°.

11 Claims, 11 Drawing Sheets

LIQUID EJECTING HEAD AND LIQUID EJECTING APPARATUS

The present application is based on, and claims priority from JP Application Serial Number 2020-020368, filed Feb. 10, 2020, the disclosure of which is hereby incorporated by reference herein in its entirety.

BACKGROUND

1. Technical Field

The present disclosure relates to a liquid ejecting head and a liquid ejecting apparatus.

2. Related Art

A liquid ejecting head that ejects liquid such as ink from a plurality of nozzles has been proposed in related art. For example, a liquid ejecting head disclosed in JP-A-2019-111738 includes a pressure compartment forming substrate, inside which pressure compartment cavities are formed, and a vibrating plate, which includes piezoelectric elements. The vibrating plate faces the pressure compartment cavities. Recesses each made up of a bottom surface and a curved surface are provided in the vibrating plate. Each pressure compartment includes the recessed portion of the vibrating plate and the pressure compartment cavity. The side surface of the pressure compartment includes the curved surface of the recessed portion and the wall surface of the pressure compartment forming substrate. The wall surface includes a horizontal surface, which is parallel to the bottom surface, and a vertical surface, which is perpendicular to the bottom surface. The vibrating plate is in contact with the pressure compartment forming substrate. The boundary between the vibrating plate and the pressure compartment forming substrate in the pressure compartment is located on a horizontal plane.

In general, stress concentrates at the boundary between two members. Therefore, in the liquid ejecting head described above, stress concentrates at the boundary between the vibrating plate and the pressure compartment forming substrate in the pressure compartment. In some instances a crack is developed at the boundary portion because of the stress concentration. For this reason, there is a problem of low durability in the liquid ejecting head according to related art.

SUMMARY

A liquid ejecting head according to a certain aspect of the present disclosure includes: an energy generation element that generates energy for applying pressure to liquid inside a pressure compartment; a vibrating plate that vibrates due to the energy; and a pressure compartment substrate that includes a first surface, which is in contact with a part of a bottom surface of the vibrating plate, and a first wall surface, which is continuous from the first surface, wherein a recessed portion that includes a bottom portion and a curved portion surrounding the bottom portion is provided in the bottom surface of the vibrating plate, the curved portion is provided from an end of the bottom portion to an end of the recessed portion and has a curved surface shape, a plurality of wall surfaces that constitute inner walls of the pressure compartment includes a surface of the recessed portion and the first wall surface, and an angle formed by the first surface and the first wall surface is greater than 90° and less than 180°.

DESCRIPTION OF EXEMPLARY EMBODIMENTS

A: First Embodiment

Figure 1:
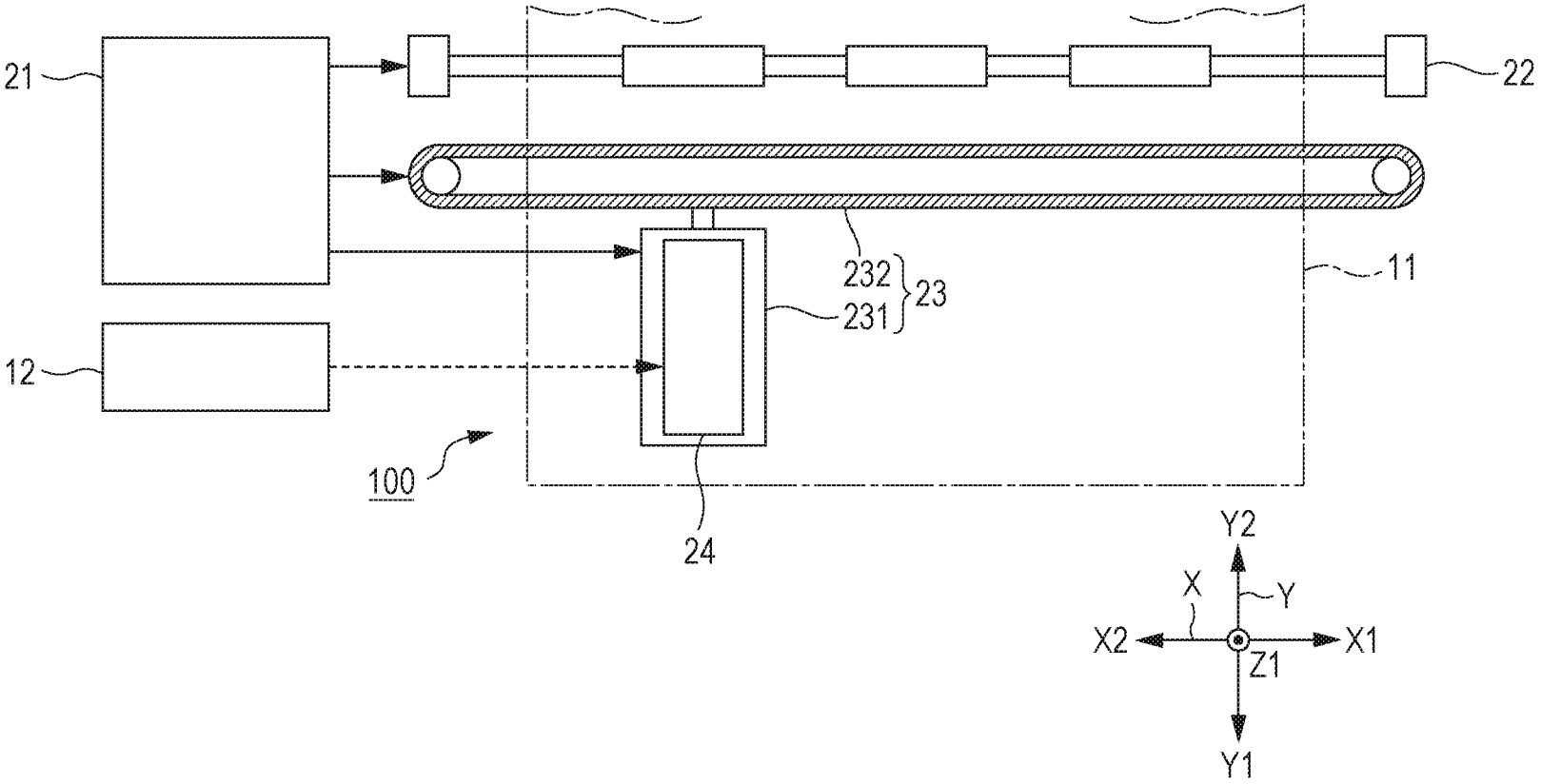
FIG. 1 is a schematic view of an example of a partial structure of a liquid ejecting apparatus according to a first embodiment.

A description is given below with reference to X, Y, and Z axes, which are orthogonal to one another. The X, Y, and Z axes are common to all of the figures that will be referred to in the description below for showing examples. As illustrated in FIG. 1, one direction along the X axis as viewed from a certain given point is denoted as X1, and the direction that is the opposite of the X1 direction is denoted as X2. The X1 direction is an example corresponding to a "first direction". Similarly, two directions that are the opposite of each other along the Y axis as viewed from a certain given point are denoted as Y1 and Y2. Two directions that are the opposite of each other along the Z axis as viewed from a certain given point are denoted as Z1 and Z2. The Z1 direction is an example corresponding to a "second direction". An X-Y plane, which includes the X axis and the Y axis, is an example corresponding to a horizontal plane. The Z axis is an axis extending in the vertical direction. The Z2 direction goes vertically downward.

FIG. 1 is a schematic view of an example of a partial structure of a liquid ejecting apparatus 100 according to the present embodiment. The liquid ejecting apparatus 100 is an ink-jet printing apparatus that ejects droplets of liquid such as ink onto a medium 11. The medium 11 is, for example, printing paper. The medium 11 may be the target of printing made of any material, for example, a resin film, a cloth, or the like.

A liquid container 12 is provided in the liquid ejecting apparatus 100. The liquid container 12 contains ink. The liquid container 12 may be, for example, a cartridge that can be detachably attached to the liquid ejecting apparatus 100, a bag-type ink pack made of a flexible film material, an ink tank from which ink can be supplied for replenishment, etc. The ink contained in the liquid container 12 may be any kind of ink.

As illustrated in FIG. 1, the liquid ejecting apparatus 100 includes a control unit 21, a transporting mechanism 22, a moving mechanism 23, and a liquid ejecting head 24. The control unit 21 includes, for example, a processing circuit such as a CPU (Central Processing Unit) or an FPGA (Field Programmable Gate Array), and a storage circuit such as a semiconductor memory, and controls various elements of the liquid ejecting apparatus 100.

The transporting mechanism 22 transports the medium 11 along the Y axis, based on control by the control unit 21. The moving mechanism 23 reciprocates the liquid ejecting head 24 along the X axis, based on control by the control unit 21. The moving mechanism 23 includes a box-like traveler 231, in which the liquid ejecting head 24 is encased, and an endless travelling belt 232, to which the traveler 231 is fixed. The following modified structure may be adopted in the present embodiment: a structure in which a plurality of liquid ejecting heads 24 is mounted on the traveler 231 and/or a structure in which the liquid container(s) 12 is mounted together with the liquid ejecting head(s) 24 on the traveler 231.

The liquid ejecting head 24 ejects ink supplied from the liquid container 12 onto the medium 11 from each of a plurality of nozzles, based on control by the control unit 21. Timed with the transportation of the medium 11 by the transporting mechanism 22 and with the reciprocating motion of the traveler 231, the liquid ejecting head 24 ejects ink onto the medium 11, thereby forming an image on the surface of the medium 11.

Figure 2:
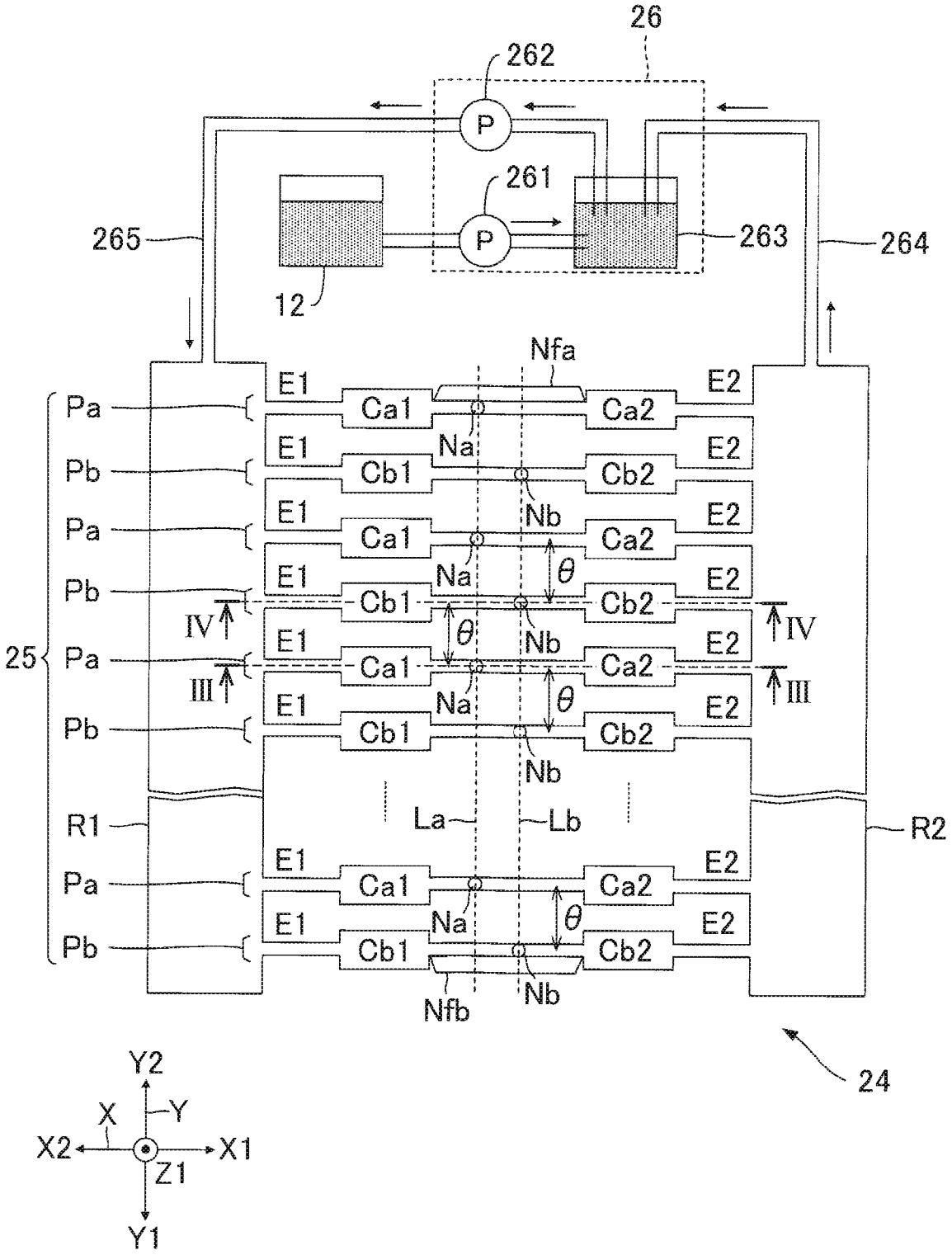
FIG. 2 is a schematic view of a passage structure inside the liquid ejecting head.

FIG. 2 is a schematic view of a passage structure inside the liquid ejecting head 24 when the liquid ejecting head 24 is viewed along the Z axis. The liquid ejecting head 24 has a surface facing the medium 11, and, in this surface, a plurality of nozzles Na and a plurality of nozzles Nb are formed as illustrated in FIG. 2. The nozzles Na are arranged along the Y axis, and the nozzles Nb are also arranged along the Y axis. Each of the plurality of nozzles Na and the plurality of nozzles Nb ejects ink in the Z-axis direction. Therefore, the Z-axis direction corresponds to the direction in which ink is ejected from each of the plurality of nozzles Na and the plurality of nozzles Nb.

As illustrated in FIG. 2, the nozzles Na constitute a first linear nozzle array La, and the nozzles Nb constitute a second linear nozzle array Lb. The first linear nozzle array La is a collective name for the group of nozzles Na arranged in a line along the Y axis. Similarly, the second linear nozzle array Lb is a collective name for the group of nozzles Nb arranged in a line along the Y axis. As illustrated in FIG. 2, the first linear nozzle array La and the second linear nozzle array Lb are arranged to form lines adjacent to each other, with a predetermined clearance being present in the X-axis direction. The respective positions of the nozzles Na in the Y-axis direction are different from the respective positions of the nozzles Nb in the Y-axis direction. As illustrated in FIG. 2, plural nozzles N including the nozzles Na and the nozzles Nb are arranged at a pitch of θ. The pitch θ is a distance between the center of the nozzle Na and the center of the nozzle Nb in the Y-axis direction. In the description below, a suffix "a" is added to reference signs that represent components related to the nozzles Na belonging to the first linear nozzle array La, and a suffix "b" is added to reference signs that represent components related to the nozzles Nb belonging to the second linear nozzle array Lb. Nozzles are referred to as "nozzles N", without being suffixed, when it is unnecessary to distinguish the nozzles Na belonging to the first linear nozzle array La and the nozzles Nb belonging to the second linear nozzle array Lb from each other. The nozzles Na and the nozzles Nb may be provided at the same respective positions in the X-axis direction such that the first linear nozzle array La and the second linear nozzle array Lb are arranged in a straight line.

As illustrated in FIG. 2, individual passage rows 25 are provided in the liquid ejecting head 24. The individual passage rows 25, a collective term, include a plurality of individual passages Pa and a plurality of individual passages Pb. Each of the plurality of individual passages Pa extends in the X1 direction and corresponds to one nozzle Na different from the others. Each of the plurality of individual passages Pa is in communication with the corresponding nozzle Na. Similarly, each of the plurality of individual passages Pb extends in the X1 direction and corresponds to one nozzle Nb different from the others. Each of the plurality of individual passages Pb is in communication with the corresponding nozzle Nb. A detailed structure of the individual passage Pa and the individual passage Pb will be described later. In the description below, individual passages are referred to as "individual passages P", without being suffixed, when it is unnecessary to distinguish the individual passages Pa and the individual passages Pb from each other.

The individual passage Pa and the individual passage Pb that face each other in the Y-axis direction, or in other words, are adjacent to each other in the Y-axis direction, are in a mutually-inverted relationship with respect to the Z axis, which is the center of inversion. Specifically, the individual passage Pa will be the same in arrangement as the individual passage Pb if the individual passage Pa is imagined to be rotated around the Z axis by 180°. The individual passage Pb will be the same in arrangement as the individual passage Pa if the individual passage Pb is imagined to be rotated around the Z axis by 180°.

As illustrated in FIG. 2, the individual passage Pa includes a pressure compartment Ca1 and a pressure compartment Ca2. The pressure compartment Ca1 and the pressure compartment Ca2 of the individual passage Pa extend in the X1 direction. Ink that is to be ejected from the nozzle Na that is in communication with the individual passage Pa is contained in the pressure compartment Ca1 and the pressure compartment Ca2. The ink is ejected from the nozzle Na when pressure inside the pressure compartment Ca1 and the pressure compartment Ca2 changes.

Similarly, the individual passage Pb includes a pressure compartment Cb1 and a pressure compartment Cb1. The pressure compartment Cb1 and the pressure compartment Cb2 of the individual passage Pb extend in the X1 direction. Ink that is to be ejected from the nozzle Nb that is in communication with the individual passage Pb is contained in the pressure compartment Cb1 and the pressure compartment Cb2. The ink is ejected from the nozzle Nb when pressure inside the pressure compartment Cb1 and the pressure compartment Cb2 changes.

In the description below, pressure compartments are referred to as "pressure compartments C", without being suffixed, when it is unnecessary to distinguish the pressure compartments Ca1 and the pressure compartments Ca2 corresponding to the respective individual passages Pa from the pressure compartments Cb1 and the pressure compartments Cb2 corresponding to the respective individual passages Pb, and vice versa.

As illustrated in FIG. 2, a first common liquid reservoir R1 and a second common liquid reservoir R2 are provided in the liquid ejecting head 24. Each of the first common liquid reservoir R1 and the second common liquid reservoir R2 extends in the Y-axis direction throughout the entire range of presence of the plurality of nozzles N. In a plan view along the Z1 direction, the individual passage rows 25 and the nozzles N are located between the first common liquid reservoir R1 and the second common liquid reservoir R2.

The plurality of individual passages P is connected in common to the first common liquid reservoir R1. Specifically, an end portion E1, which is located at the X2-directional end, of each of the plurality of individual passages P is connected to the first common liquid reservoir R1. Similarly, the plurality of individual passages P is connected in common to the second common liquid reservoir R2. Specifically, an end portion E2, which is located at the X1-directional end, of each of the plurality of individual passages P is connected to the second common liquid reservoir R2. In the liquid ejecting head 24, the first common liquid reservoir R1 and the second common liquid reservoir R2 are in communication with each other through each of the plurality of individual passages P. Because of this structure, ink that is supplied from the first common liquid reservoir R1 to each of the plurality of individual passages P is ejected from the corresponding nozzle N. Of the ink that is supplied from the first common liquid reservoir R1 to each of the plurality of individual passages P, a part that is not ejected from the corresponding nozzle N is discharged into the second common liquid reservoir R2.

As illustrated in FIG. 2, the liquid ejecting head 24 includes a circulation mechanism 26. The circulation mechanism 26 is a mechanism that causes the ink discharged from each of the plurality of individual passages P into the second common liquid reservoir R2 to flow back into the first common liquid reservoir R1. The circulation mechanism 26 includes a first supply pump 261, a second supply pump 262, a pooling container 263, a circulation passage 264, and a supply passage 265.

The first supply pump 261 is a pump that supplies ink contained in the liquid container 12 to the pooling container 263. The pooling container 263 is a sub tank that temporarily contains the ink supplied from the liquid container 12.

The circulation passage 264 is a passage through which the second common liquid reservoir R2 is in communication with the pooling container 263. Ink is discharged in common to the circulation passage 264 via the second common liquid reservoir R2 from discharge passages Ra2 illustrated in FIG. 3 and discharge passages Rb2 illustrated in FIG. 4.

The ink contained in the liquid container 12 is supplied to the pooling container 263 by the first supply pump 261. In addition, the ink discharged into the second common liquid reservoir R2 from each of the plurality of individual passages P is supplied through the circulation passage 264 to the pooling container 263.

The second supply pump 262 is a pump that sends out the ink pooled in the pooling container 263. The ink sent out from the second supply pump 262 is supplied through the supply passage 265 into the first common liquid reservoir R1.

The plurality of individual passages P constituting the individual passage rows 25 includes the plurality of individual passages Pa and the plurality of individual passages Pb. Each of the plurality of individual passages Pa is an individual passage P that is in communication with one nozzle Na among those of the first linear nozzle array La. Each of the plurality of individual passages Pb is an individual passage P that is in communication with one nozzle Nb among those of the second linear nozzle array Lb. The individual passages Pa and the individual passages Pb are arranged alternately in the Y-axis direction. Because of this structure, the individual passage Pa and the individual passage Pb face each other in the Y-axis direction, or in other words, are adjacent to each other in the Y-axis direction.

As illustrated in FIG. 2, the individual passage Pa includes a nozzle passage Nfa. The nozzle passage Nfa extends in the X1 direction. As illustrated in FIG. 2, in a Z1-directional view, that is, when the nozzle passage Nfa is viewed in the Z1 direction, the nozzle passage Nfa is located between the pressure compartment Ca1 and the pressure compartment Ca2. The nozzle passage Nfa is in communication with the pressure compartment Ca1 and the pressure compartment Ca2. The nozzle Na from which ink supplied from the pressure compartment Ca1 is ejected is provided in the nozzle passage Nfa.

As illustrated in FIG. 2, the individual passage Pb includes a nozzle passage Nfb. The nozzle passage Nfb extends in the X1 direction. As illustrated in FIG. 2, in a Z1-directional view, that is, when the nozzle passage Nfb is viewed in the Z1 direction, the nozzle passage Nfb is located between the pressure compartment Cb1 and the pressure compartment Cb2. The nozzle passage Nfb is in communication with the pressure compartment Cb1 and the pressure compartment Cb2. The nozzle Nb from which ink supplied from the pressure compartment Cb1 is ejected is provided in the nozzle passage Nfb.

The nozzle passages Nfa and the nozzle passages Nfb are arranged to form a linear array in the Y-axis direction. The nozzle passage Nfa and the nozzle passage Nfb are arranged next to each other, with a predetermined clearance being present in the Y-axis direction. The nozzle passage Nfa and the nozzle passage Nfb that face each other in the Y-axis direction are in a mutually-inverted relationship with respect to the Z axis, which is the center of inversion.

In the liquid ejecting head 24 according to the present embodiment, as illustrated in FIG. 2, the plurality of pressure compartments Ca1 corresponding to the respective nozzles Na different from one another and belonging to the first linear nozzle array La, and the plurality of pressure compartments Cb1 corresponding to the respective nozzles Nb different from one another and belonging to the second linear nozzle array Lb, are arranged to form a linear array in the Y-axis direction. Similarly, the plurality of pressure compartments Ca2 corresponding to the respective nozzles Na different from one another and belonging to the first linear nozzle array La, and the plurality of pressure compartments Cb2 corresponding to the respective nozzles Nb different from one another and belonging to the second linear nozzle array Lb, are arranged to form a linear array in the Y-axis direction. The array made up of the plurality of pressure compartments Ca1 and the plurality of pressure compartments Cb1, and the array made up of the plurality of pressure compartments Ca2 and the plurality of pressure compartments Cb2, are provided in two columns, with a predetermined distance therebetween in the X-axis direction. In the example described and illustrated here, the position of each of the plurality of pressure compartments Ca1 in the Y-axis direction is the same as the position of the corresponding one of the plurality of pressure compartments Ca2 in the Y-axis direction. However, these positions may be different from each other. In the example described and illustrated here, the position of each of the plurality of pressure compartments Cb1 in the Y-axis direction is the same as the position of the corresponding one of the plurality of pressure compartments Cb1 in the Y-axis direction. However, similarly, these positions may be different from each other.

In the liquid ejecting head 24, since ink is circulated when an ink-ejecting operation is performed, the thickening of the ink or the precipitation of ingredients of the ink is less likely to occur in the neighborhood of the nozzles Na and the nozzles Nb, thereby preventing the deterioration of ink-ejection characteristics. Therefore, it is possible to make ink-ejection characteristics almost uniform. A reduction in non-uniformity of ink-ejection characteristics results in improved ink-ejection quality. The "ejection characteristics" mentioned here is, for example, an amount of ink ejected or a speed at which ink is ejected.

Figure 3:
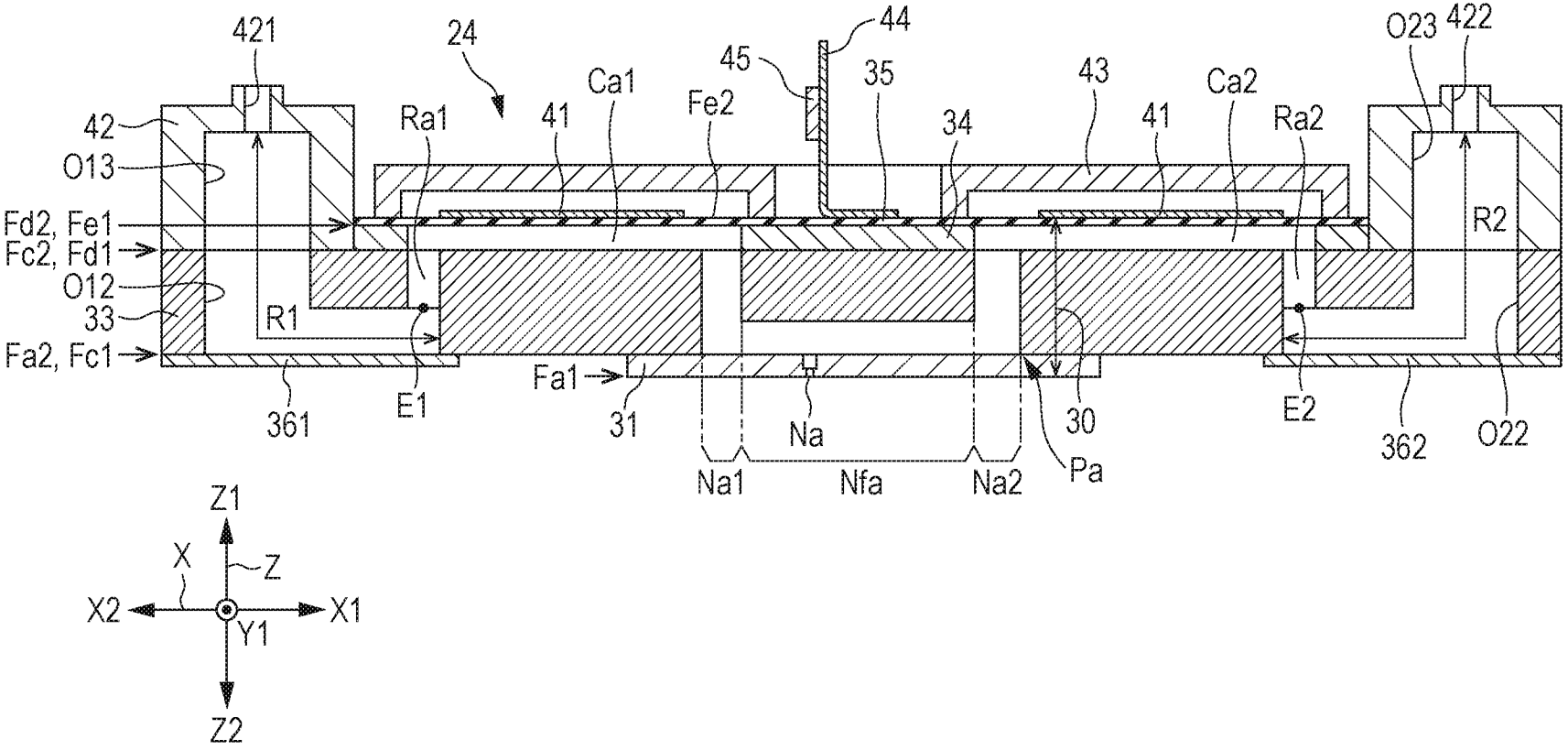
FIG. 3 is a sectional view taken along the line III-III of FIG. 2.
Figure 4:
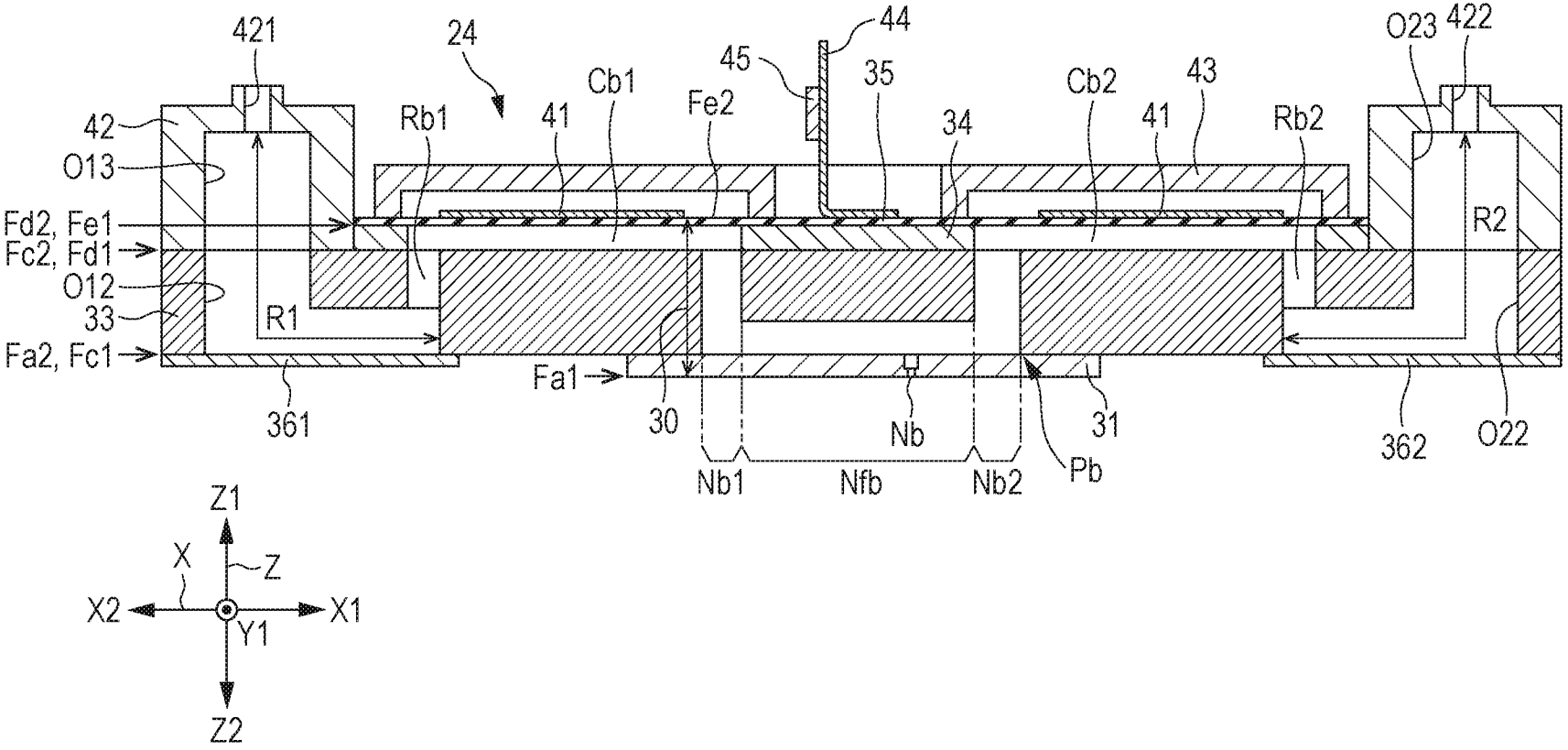
FIG. 4 is a sectional view taken along the line IV-IV of FIG. 2.

Next, a detailed structure of the liquid ejecting head 24 will now be described. FIG. 3 is a sectional view taken along the line III-III of FIG. 2. FIG. 4 is a sectional view taken along the line IV-IV of FIG. 2. FIG. 3 shows a cross section passing through the individual passage Pa. FIG. 4 shows a cross section passing through the individual passage Pb.

As illustrated in FIGS. 3 and 4, the liquid ejecting head 24 includes a passage structure stack 30, a plurality of piezoelectric elements 41, a casing portion 42, a protection substrate 43, and a wiring substrate 44. The passage structure stack 30 is a structure member inside which passages are formed, including the first common liquid reservoir R1, the second common liquid reservoir R2, the plurality of individual passages P, and the plurality of nozzles N.

The passage structure stack 30 has a structure in which a nozzle plate 31, a passage substrate 33, a pressure compartment substrate 34, and a vibrating plate 35 are stacked in this order as viewed in the Z1 direction. These components that constitute the passage structure stack 30 are manufactured by, for example, processing a monocrystalline silicon substrate by using a commonly-used semiconductor manufacturing processing technology. The vibrating plate 35 extends in the X1 direction.

The plurality of nozzles N is formed in the nozzle plate 31. Each of the plurality of nozzles N is a circular through hole through which ink passes. As illustrated in FIGS. 3 and 4, the nozzle plate 31 is a plate-shaped member that has a surface Fa1 oriented in the Z2 direction and a surface Fat oriented in the Z1 direction. The passage substrate 33 is a plate-shaped member that has a surface Fc1 oriented in the Z2 direction and a surface Fc2 oriented in the Z1 direction.

Each of the components that constitute the passage structure stack 30 has a rectangular shape. These components are bonded to one another by using, for example, an adhesive. For example, the surface Fat of the nozzle plate 31 is bonded to the surface Fc1 of the passage substrate 33. The surface Fc2 of the passage substrate 33 is bonded to the surface Fd1 of the pressure compartment substrate 34. The surface Fd2 of the pressure compartment substrate 34 is bonded to the surface Fe1 of the vibrating plate 35. The surface Fe1 of the vibrating plate 35 is an example of the bottom surface of a vibrating plate.

A space O12 and a space O22 are formed in the passage substrate 33. Each of the space O12 and the space O22 is an opening that is elongated in the Y-axis direction. A vibration absorbing member 361, with which the space O12 is closed, and a vibration absorbing member 362, with which the space O22 is closed, are provided on the surface Fc1 of the passage substrate 33. Each of the vibration absorbing member 361 and the vibration absorbing member 362 is a membranous member made of an elastic material.

The casing portion 42 is a case for containing ink. The casing portion 42 is bonded to the surface Fc2 of the passage substrate 33. A space O13, which is in communication with the space O12, and a space O23, which is in communication with the space O22, are formed in the casing portion 42. Each of the space O13 and the space O23 is a space that is elongated in the Y-axis direction. The space O12 and the space O13 constitute the first common liquid reservoir R1 by being in communication with each other. Similarly, the space O22 and the space O23 constitute the second common liquid reservoir R2 by being in communication with each other. The vibration absorbing member 361 constitutes the floor of the first common liquid reservoir R1 and absorbs the pressure fluctuations of ink inside the first common liquid reservoir R1. The vibration absorbing member 362 constitutes the floor of the second common liquid reservoir R2 and absorbs the pressure fluctuations of ink inside the second common liquid reservoir R2.

A supply inlet 421 and a discharge outlet 422 are formed in the casing portion 42. The supply inlet 421 is a conduit that is in communication with the first common liquid reservoir R1. The supply inlet 421 is connected to the supply passage 265 of the circulation mechanism 26. The ink sent out from the second supply pump 262 to the supply passage 265 flows through the supply inlet 421 to be supplied to the first common liquid reservoir R1. The other, the discharge outlet 422, is a conduit that is in communication with the second common liquid reservoir R2. The discharge outlet 422 is connected to the circulation passage 264 of the circulation mechanism 26. Ink inside the second common liquid reservoir R2 is supplied to the circulation passage 264 through the discharge outlet 422.

The pressure compartments Ca1 and the pressure compartments Ca2, and the pressure compartments Cb1 and the pressure compartments Cb1, are provided in the pressure compartment substrate 34. Each of the plurality of pressure compartments C is a gap between the surface Fc2 of the passage substrate 33 and the vibrating plate 35. In a plan view along the Z1 direction, each of the plurality of pressure compartments C has an elongated shape along the X axis and extends in the X1 direction.

The vibrating plate 35 is a plate-shaped member that is able to vibrate elastically. At least a part of the vibrating plate 35 is made of, for example, silicon oxide ($SiO_2$). More specifically, the vibrating plate 35 has a multiple-layer structure made up of a first layer of silicon oxide ($SiO_2$) serving as an elastic layer and a second layer of zirconium oxide ($ZrO_2$) serving as an insulating layer. The vibrating plate 35 and the pressure compartment substrate 34 may be formed integrally by selectively removing a part, in the thickness direction, of an area corresponding to the pressure compartment C in a plate-shaped member that has a predetermined thickness. The vibrating plate 35 may have a single-layer structure.

The piezoelectric elements 41 corresponding to the respective pressure compartments C different from one another are provided on the surface Fe2 of the vibrating plate 35. The piezoelectric elements 41 corresponding to the respective pressure compartments C overlap with the respective pressure compartments C in a plan view along the Z1 direction. Specifically, each of the plurality of piezoelectric elements 41 has a layered structure made up of a first electrode and a second electrode being the opposite of each other and a piezoelectric substance layer formed between these two electrodes. Each of the plurality of piezoelectric elements 41 is an energy generation element that generates energy for applying pressure to ink inside the corresponding pressure compartment C. The vibrating plate 35 vibrates due to energy generated by the piezoelectric element 41. Specifically, the piezoelectric element 41 deforms itself by receiving a drive signal, thereby causing the vibrating plate 35 to vibrate. The pressure compartment C expands and contracts when the vibrating plate 3 vibrates. Due to the expansion and contraction of the pressure compartment C, pressure is applied to ink from the pressure compartment C. Because of this pressure, ink is ejected from the nozzle N.

The protection substrate 43 is a plate-type member provided on the surface Fe2 of the vibrating plate 35. The protection substrate 43 protects the plurality of piezoelectric elements 41 and reinforces the mechanical strength of the vibrating plate 35. The plurality of piezoelectric elements 41 is housed between the protection substrate 43 and the vibrating plate 35. The wiring substrate 44 is mounted on the surface Fe2 of the vibrating plate 35. The wiring substrate 44 is a mounted component that provides electric connection between the control unit 21 and the liquid ejecting head 24. For example, a flexible wiring board such as FPC (Flexible Printed Circuit) or FFC (Flexible Flat Cable) may be preferably used as the wiring substrate 44. A drive circuit 45 for supplying a drive signal to each piezoelectric element 41 is mounted on the wiring substrate 44. The drive circuit 45 serves as a controller that controls operation of ejection from the liquid ejecting head 24.

Figure 5:
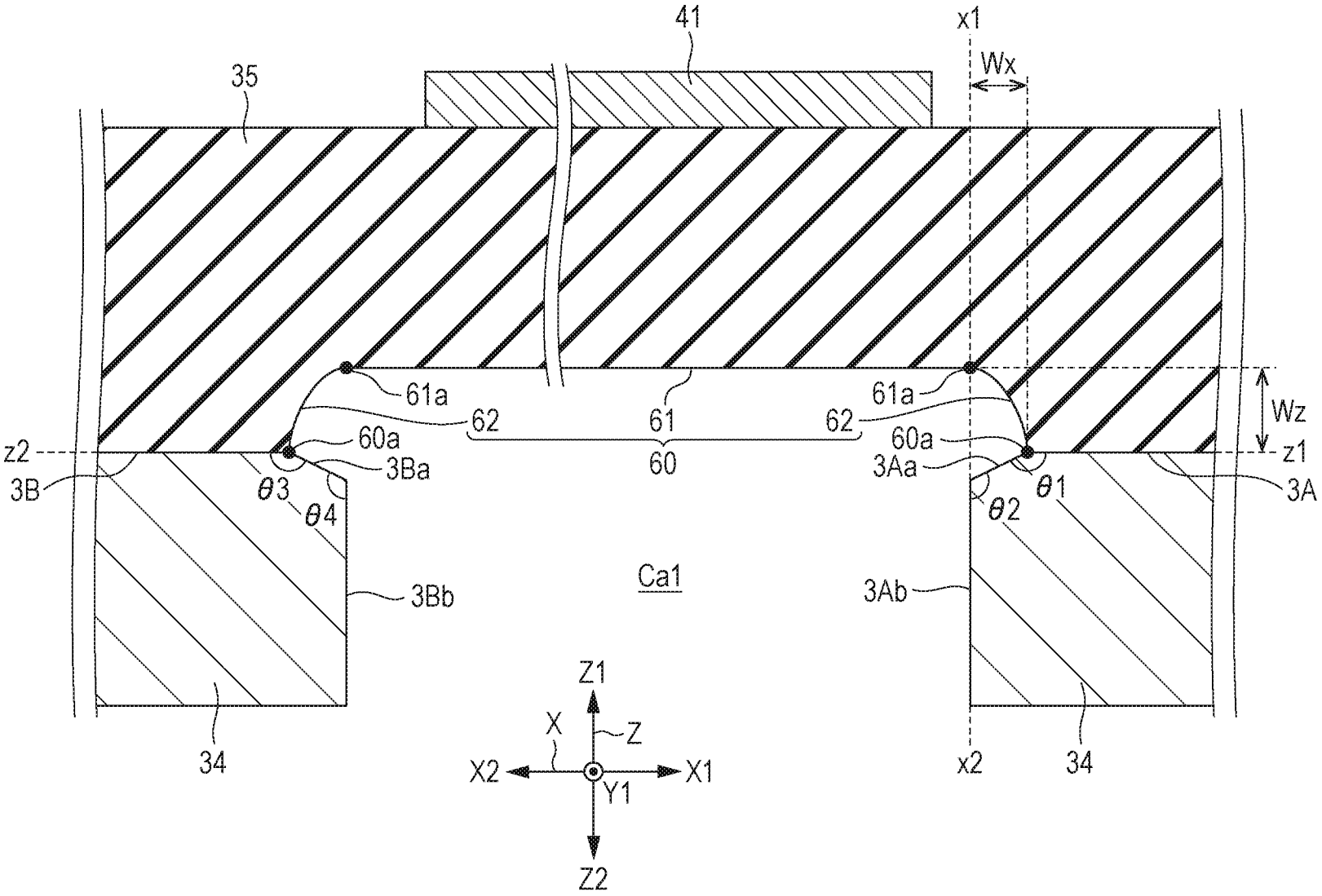
FIG. 5 is a partial enlarged sectional view of a part corresponding to a pressure compartment Ca1 illustrated in FIG. 3.

Next, a detailed structure of the pressure compartment Ca1 will now be described. The structure of the pressure compartment Ca2 illustrated in FIG. 3, and the pressure compartment Cb1 and the pressure compartment Cb1 illustrated in FIG. 4, is the same as the structure of the pressure compartment Ca1. FIG. 5 is a partial enlarged sectional view of a part corresponding to the pressure compartment Ca1 illustrated in FIG. 3. As illustrated in FIG. 5, a recessed portion 60 is provided in the surface Fe1 of the vibrating plate 35. The recessed portion 60 includes a bottom portion 61 and a curved portion 62. The bottom portion 61 is the bottom of the recessed portion 60. Therefore, the bottom portion 61 is located at the most distant position in the Z1 direction in the recessed portion 60 when the recessed portion 60 is viewed in the Y1 direction. The bottom portion 61 is, for example, a plane that is parallel to the X-Y plane. The curved portion 62 surrounds the bottom portion 61. The curved portion 62 is provided from an end 61*a* of the bottom portion 61 to an end 60*a* of the recessed portion 60. In the description below, the end 60*a* of the recessed portion 60 is referred to as a first end 60*a*, and the end 61*a* of the bottom portion 61 is referred to as a second end 61*a*. If the curved portion 62 is assumed to be cut along a plurality of planes parallel to the X-Y plane, its cross-sectional area size in the plurality of cross sections increases toward the Z2 direction. The curved portion 62 has a curved surface shape. The width of the curved portion 62 in the Z1 direction is denoted as Wz. The width of the curved portion 62 in the X1 direction is denoted as Wx. The curved surface of the curved portion 62 has, for example, a shape of an arc. The width Wx is equal to the width Wz if the shape of the curved portion 62 is a regular arc. The shape of the curved surface of the curved portion 62 is not limited to an arc.

The surface Fd2 of the pressure compartment substrate 34 includes a first surface 3A and a second surface 3B. The first surface 3A is in contact with a part of the surface Fe1, which is the bottom surface of the vibrating plate 35. The second surface 3B is in contact with a part of the surface Fe1, which is the bottom surface of the vibrating plate 35. The pressure compartment substrate 34 includes a first wall surface 3Aa, which is continuous from the first surface 3A, and a second wall surface 3Ab, which is continuous from the first wall surface 3Aa. The pressure compartment substrate 34 further includes a third wall surface 3Ba, which is continuous from the second surface 3B, and a fourth wall surface 3Bb, which is continuous from the third wall surface 3Ba. A plurality of wall surfaces that constitute the inner walls of the pressure compartment Ca1 includes the surface of the recessed portion 60, the first wall surface 3Aa, the second wall surface 3Ab, the third wall surface 3Ba, and the fourth wall surface 3Bb. The third wall surface 3Ba faces the first wall surface 3Aa in the X1 direction. The fourth wall surface 3Bb faces the second wall surface 3Ab in the X1 direction.

In this example, when the recessed portion 60 is viewed in the Z1 direction, the position x1 of the second end 61*a* in the X1 direction is substantially the same as the position x2 of the second wall surface 3Ab in the X1 direction. The position x1 of the second end 61*a* is the position of the boundary between the bottom portion 61 and the curved portion 62 in the X1 direction.

In addition, the position z2 of the second surface 3B in the Z1 direction is substantially the same as the position z1 of the first surface 3A in the Z1 direction.

The angle formed by the first surface 3A and the first wall surface 3Aa is denoted as θ1. The angle formed by the first wall surface 3Aa and the second wall surface 3Ab is denoted as θ2. The angle formed by the second surface 3B and the third wall surface 3Ba is denoted as θ3. The angle formed by the third wall surface 3Ba and the fourth wall surface 3Bb is denoted as θ4. In the description below, an angle formed by one surface and another surface of a certain member does not mean an exterior angle thereat of the member but means an interior angle thereat of the member.

Figure 6:
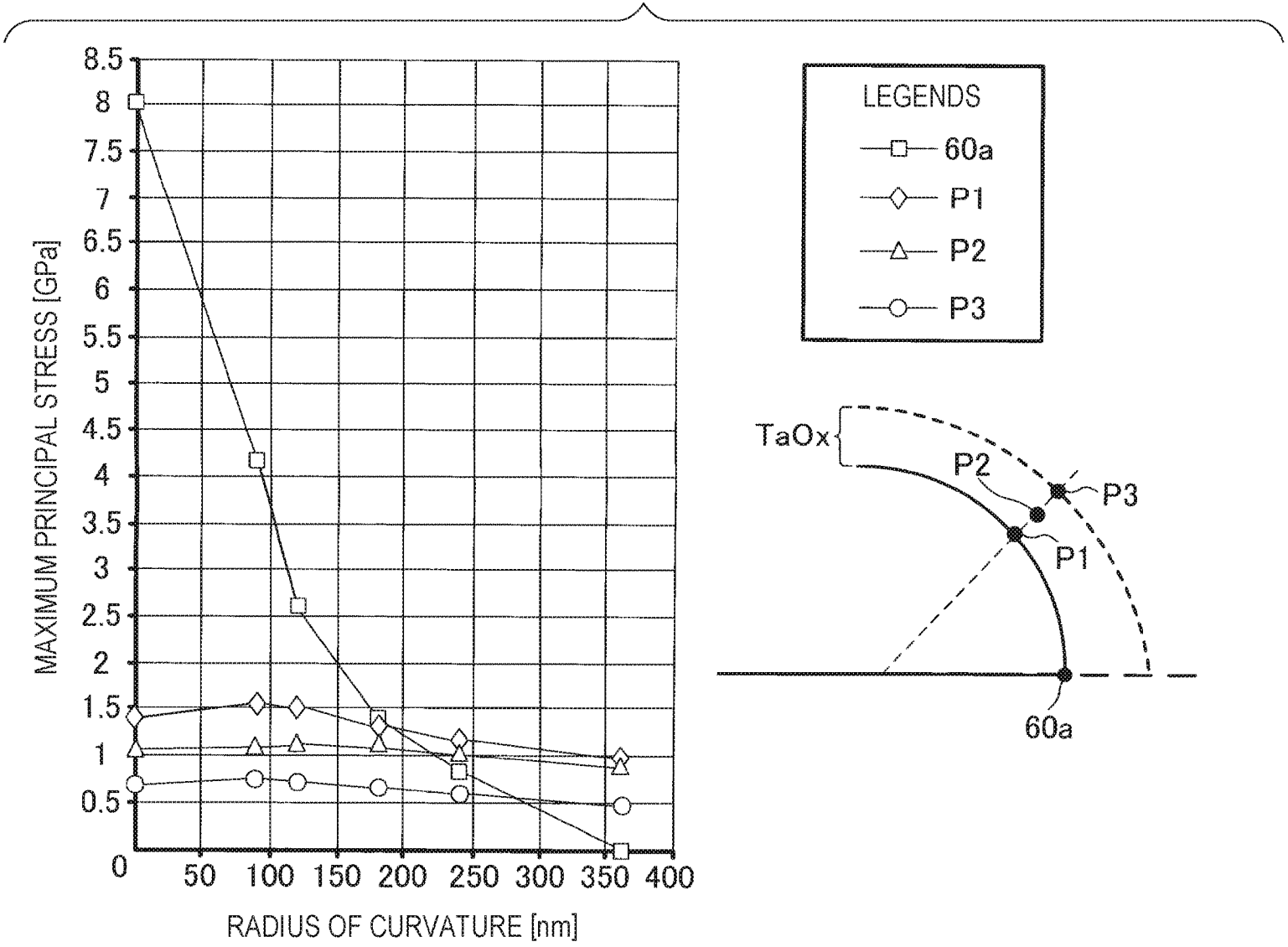
FIG. 6 is a graph that shows a result of a simulation about a relationship between the stress distribution of a curved portion and the radius of curvature of the curved portion.

A displacement of the vibrating plate 35 along the Z axis occurs when a drive signal is applied to the piezoelectric element 41. The displacement of the vibrating plate 35 gives rise to stress. A result of a simulation about a relationship between the stress distribution of the curved portion 62 and the radius of curvature of the curved portion 62 will now be explained. In the simulation, the vibrating plate 35 in which silicon oxide ($SiO_2$) is coated with tantalum oxide (TaOx) having a thickness of 30 nm is assumed. The angle θ1 is set to be 180°. In this case, the first surface 3A and the first wall surface 3Aa are included in the same plane. In addition, the curved surface of the curved portion 62 is assumed to have an ideal arc shape. The result of the simulation is illustrated in FIG. 6. In FIG. 6, the vertical axis represents maximum principal stress, and the horizontal axis represents the radius of curvature. A point P1 is a location where the principal stress is maximized in the surface facing the pressure compartment Ca1. A point P2 is a location where the principal stress is maximized at the center in the thickness direction of tantalum oxide. A point P3 is a location where the principal stress is maximized in silicon oxide.

As illustrated in FIG. 6, stress concentration at the first end 60*a* occurs when the radius of curvature is 150 nm or less. As can be seen, the location where the stress concentrates moves from the first end 60*a* toward the center of the arc of the curved portion 62 when the radius of curvature increases to exceed 150 nm. The stress at the first end 60*a* is lessened if the radius of curvature is increased. In order to increase the radius of curvature, it is necessary to increase the thickness of the vibrating plate 35 in the film thickness direction, or in other words, necessary to increase the width of the vibrating plate 35 in the Z1 direction.

Various manufacturing processes can be used for manufacturing the vibrating plate 35. In a certain manufacturing process, if the width of the vibrating plate 35 in the Z1 direction is increased, an amount of warping of a wafer increases due to a compressive stress of silicon oxide that is a constituent of the vibrating plate 35. For this reason, depending on the kind of the manufacturing process used, the warping of the wafer makes it difficult to manufacture the vibrating plate 35. Alternatively, depending on the kind of the manufacturing process used, it is necessary to add a step for reducing the warping of the wafer. For this reason, depending on the kind of the manufacturing process used, it is demanded to set the radius of curvature to be not greater than 150 nm in order to decrease the thickness of the vibrating plate 35 in the film thickness direction. In this case, it is desirable to prevent the stress concentration at the first end 60*a*.

Referring back to FIG. 5, the explanation is continued. The structure of the present embodiment includes the first wall surface 3Aa, which is inclined with respect to the first surface 3A, and the third wall surface 3Ba, which is inclined with respect to the second surface 3B. Specifically, the angle θ1 formed by the first surface 3A and the first wall surface 3Aa can be expressed by Formula 1 shown below.

$$90<\theta 1<180 \quad \text{Formula 1}$$

That is, the angle θ1 is greater than 90° and is less than 180°.

Therefore, the angle θ2 can be expressed as follows.

$$\theta 2=180-\{180-90-(180-\theta 1)\}=270-\theta 1 \quad \text{Formula 2}$$

That is, the angle θ2 formed by the first wall surface 3Aa and the second wall surface 3Ab is substantially equal to an angle obtained by subtracting the angle θ1 formed by the first surface 3A and the first wall surface 3Aa from 270°. In this specification, the phrase "substantially equal to" has a meaning of approximate equality not precluding a margin of error in manufacturing.

Formula 3 can be derived from Formulae 1 and 2.

$$90<\theta 2<180 \quad \text{Formula 3}$$

That is, the angle θ2 is greater than 90° and is less than 180°.

Next, the angle θ3 formed by the second surface 3B and the third wall surface 3Ba can be expressed by Formula 4 shown below.

$$90<\theta 3<180 \quad \text{Formula 4}$$

That is, the angle θ3 is greater than 90° and is less than 180°.

The angle θ4 formed by the third wall surface 3Ba and the fourth wall surface 3Bb can be expressed by Formula 5 shown below.

$$\theta 4=180-\{180-90-(180-\theta 3)\}=270-\theta 3 \quad \text{Formula 5}$$

That is, the angle θ4 formed by the third wall surface 3Ba and the fourth wall surface 3Bb is substantially equal to an angle obtained by subtracting the angle θ3 formed by the second surface 3B and the third wall surface 3Ba from 270°.

Formula 6 can be derived from Formulae 4 and 5.

$$90<\theta 4<180 \quad \text{Formula 6}$$

That is, the angle θ4 is greater than 90° and is less than 180°.

By setting the angle θ1, the angle θ2, the angle θ3, and angle θ4 as explained above, it is possible to make the magnitude of the stress at the first end 60*a* less than that in a case of θ1=θ3=180°.

Air could happen to enter through the nozzle Na when the liquid ejecting head 24 is in an operating state. If there is an air bubble in ink inside the pressure compartment Ca1 due to the entry of air, compliance will be greater as compared with a case where there is no air bubble in ink inside the pressure compartment Ca1. For this reason, the displacement of the vibrating plate 35 will be greater as compared with a case where there is no air bubble in ink inside the pressure compartment Ca1 even if the same drive signal is applied to the piezoelectric element 41. Moreover, a natural frequency that is determined depending on the shape of the pressure compartment Ca1, the piezoelectric element 41, the vibrating plate 35, and the viscosity of ink, etc. changes because the compliance increases. In some cases, the vibrating plate 35 resonates due to the change in the natural frequency, resulting in an increase in the displacement of the vibrating plate 35. The stress at the first end 60*a* increases when the displacement of the vibrating plate 35 increases. Therefore, if there is an air bubble in ink inside the pressure compartment Ca1 due to the entry of air, a possibility that a crack will be developed at the first end 60*a* increases. It is desirable that the air bubble that is present in ink inside the pressure compartment Ca1 due to the entry of air should go out of the pressure compartment Ca1 quickly. However, if the angle θ1 is 180°, it is more likely that the air bubble that is trapped into the curved portion 62 will stay inside the curved portion 62.

As described above, in the present embodiment, the first wall surface 3Aa is inclined with respect to the first surface 3A, and the third wall surface 3Ba is inclined with respect to the second surface 3B. Therefore, even if an air bubble strays into the curved portion 62, it becomes easier for the air bubble to go out of the curved portion 62. Then, the air bubble having gone out of the curved portion 62 is discharged out of the pressure compartment Ca1 due to the circulation of ink. Therefore, by inclining the first wall surface 3Aa with respect to the first surface 3A and inclining the third wall surface 3Ba with respect to the second surface 3B also from a viewpoint of preventing an air bubble from staying inside the curved portion 62, it is possible to reduce the magnitude of the stress at the first end 60*a*.

As explained above, the disclosed structure reduces the magnitude of the stress at the first end 60*a* by inclining the first wall surface 3Aa with respect to the first surface 3A and inclining the third wall surface 3Ba with respect to the second surface 3B. Consequently, it is possible to prevent a crack from being developed at the first end 60*a*. Therefore, the durability of the liquid ejecting head 24 improves.

Moreover, since it is possible to reduce the magnitude of the stress at the first end 60*a*, it is all right to set the radius of curvature of the curved portion 62 to be 150 nm or less. Setting the radius of curvature of the curved surface in this way makes it easier to manufacture the vibrating plate 35.

Next, the angle θ1 and the angle θ2 will now be studied from a viewpoint of a structural crosstalk regarding the pressure compartments C. The structural crosstalk regarding the pressure compartments C means the following phenomenon. Regarding the pressure compartment Ca1 and the pressure compartment Cb1 that are located next to each other along the Y axis, vibrations caused by a change in the internal pressure of one of these two pressure compartments C are transmitted to the other of these two pressure compartments C. The ejection characteristics of the nozzle that is in communication with the other of these two pressure compartments C deteriorate as a result of the transmission of the vibrations.

Figure 7:
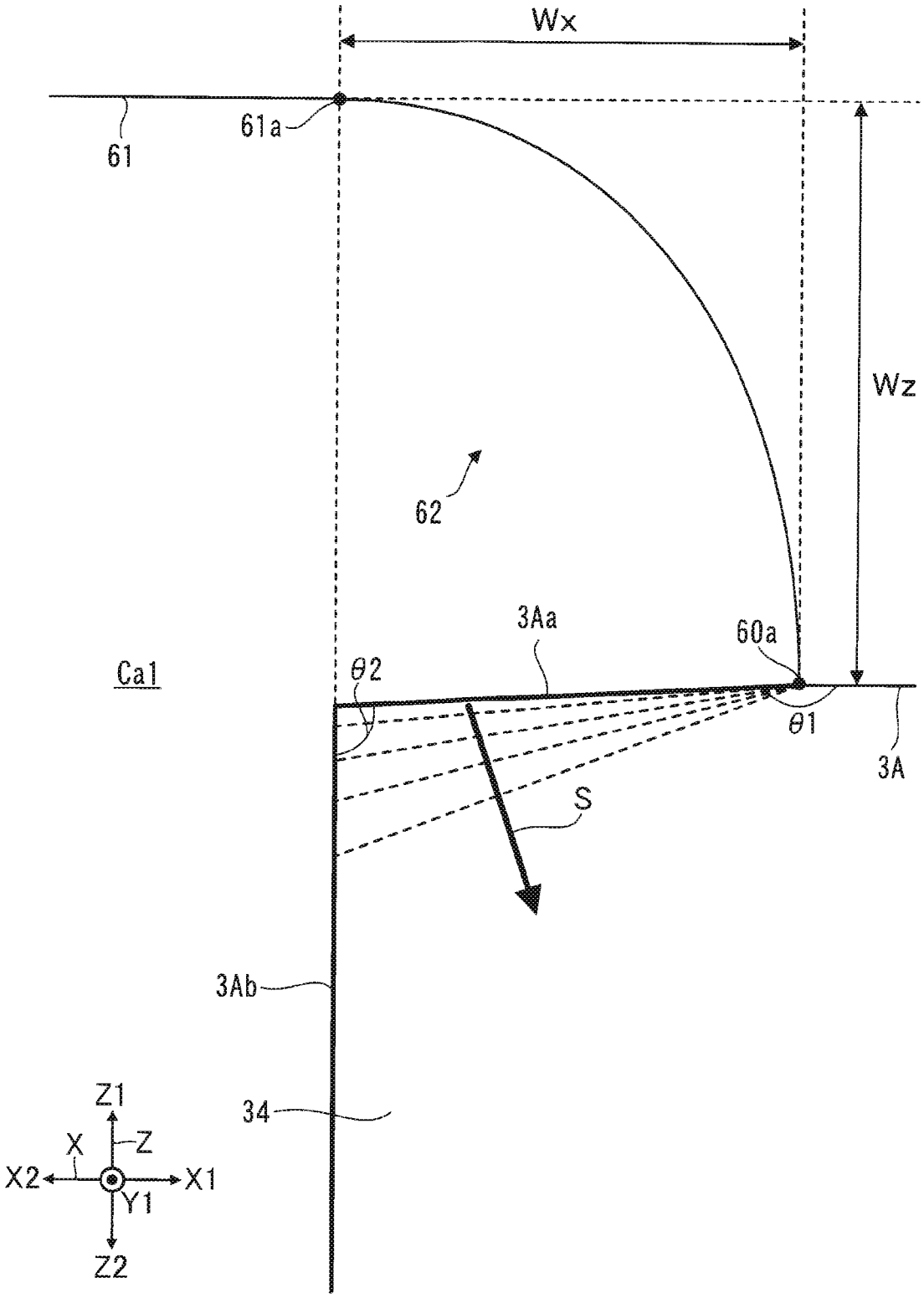
FIG. 7 is a diagram for schematically explaining the layout of a first wall surface and a second wall surface when an angle θ1 and an angle θ2 are changed.

FIG. 7 is a diagram for schematically explaining the layout of the first wall surface 3Aa and the second wall surface 3Ab when the angle θ1 and the angle θ2 are changed. The pressure compartment Ca1 illustrated in FIG.

7 is partitioned off from the pressure compartment Cb1 adjacent to the pressure compartment Ca1 by the pressure compartment substrate 34. In other words, the pressure compartment substrate 34 serves as a sidewall for partitioning between the pressure compartment Ca1 and the pressure compartment Cb1.

As illustrated in FIG. 7, the position of the first wall surface 3Aa changes in a direction indicated by an arrow S when the angle θ1 is decreased gradually. Since there is a relationship expressed by Formula 2 between the angle θ1 and the angle θ2, the angle θ2 increases when the angle θ1 decreases.

In addition, the cross-sectional area size of the pressure compartment substrate 34 decreases when the angle θ1 decreases. As a result, the strength of the sidewall constituted by the pressure compartment substrate 34 between the pressure compartment Ca1 and the pressure compartment Cb1 decreases. Since the decrease in the strength of the sidewall makes it more likely that the vibrations will be transmitted, the structural crosstalk increases. On the other hand, as the angle θ2 increases with a decrease in the angle θ1, the stress at the first end 60*a* decreases.

Therefore, there is a trade-off relationship between the stress at the first end 60 and the structural crosstalk. From the viewpoint of mitigating the influence of the structural crosstalk to a tolerable level while ensuring that the durability of the liquid ejecting head 24 will not be sacrificed beyond a tolerable level due to the stress at the first end 60, it will be advantageous if the angle θ1 is greater than 150° and less than 180°. It will be advantageous if the angle θ2 is greater than 90° and less than 120°.

In addition, it will be advantageous if the magnitude of the stress at the first end 60*a* of the first surface 3A is equal to the magnitude of the stress at the first end 60*a* of the second surface 3B. If the magnitude of the stress at the first end 60*a* of the first surface 3A is different from the magnitude of the stress at the first end 60*a* of the second surface 3B, the possibility of cracking at the more stressed one of these two first ends 60*a* increases. This is the reason why the equal stress mentioned here is advantageous. Therefore, it will be advantageous if the angle θ1 and the angle θ3 are substantially equal to each other. It will be advantageous if the angle θ2 and the angle θ4 are substantially equal to each other.

In the description below, an advantageous example of the curved shape of the curved portion 62 that is suited for lessening the stress at the first end 60*a* will be explained.

Figure 8:
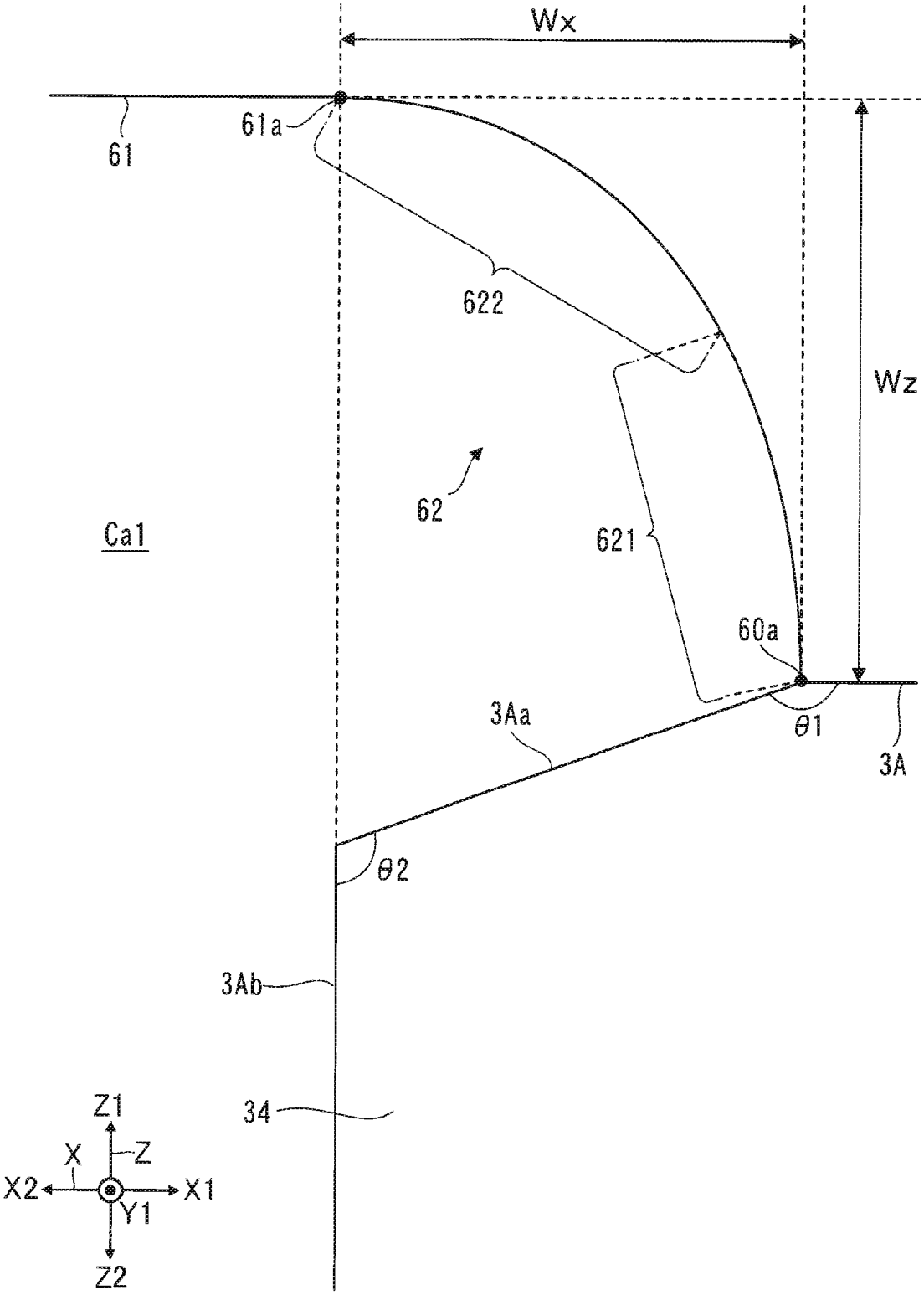
FIG. 8 is an enlarged view of the curved portion illustrated in FIG. 6.

FIG. 8 is an enlarged view of the curved portion 62 illustrated in FIG. 6. As illustrated in FIG. 8, it will be advantageous if the width Wz of the curved portion 62 in the Z1 direction is greater than the width Wx of the curved portion 62 in the X1 direction. As illustrated in FIG. 8, the curved portion 62 includes a first portion 621, which includes the first end 60*a*, and a second portion 622, which includes the second end 61*a*. That is, the first portion 621 includes the boundary between the pressure compartment substrate 34 and the curved portion 62. The second portion 622 includes the boundary between the bottom portion 61 and the curved portion 62. In this example, the degree by which the first portion 621 is curved is greater than the degree by which the second portion 622 is curved. In other words, the radius of curvature of the curved portion 62 is not uniform, and, specifically, the radius of curvature of the first portion 621 is larger than the radius of curvature of the second portion 622. Because of this relationship between the radius of curvature of the first portion 621 and the radius of curvature of the second portion 622, the width Wz of the curved portion 62 in the Z1 direction is greater than the width Wx of the curved portion 62 in the X1 direction.

The stress at the first end 60 is more influenced by the first portion 621 than by the second portion 622. Therefore, the magnitude of the stress at the first end 60*a* when the radius of curvature of the first portion 621 is relatively large is less than the magnitude of the stress at the first end 60*a* when the radius of curvature of the first portion 621 is relatively small. Therefore, setting the radius of curvature of the first portion 621 to be larger than the radius of curvature of the second portion 622 makes it possible to lessen the stress at the first end 60 and decrease the width Wz of the curved portion 62 in the Z1 direction. Therefore, it is possible to improve the durability of the liquid ejecting head 24 and decrease the possibility that a problem will occur due to the warping of a wafer.

Next, a relationship among the width Wz of the curved portion 62 in the Z1 direction, the width Wx of the curved portion 62 in the X1 direction, and the angle θ1 will now be explained. The inventors of the present application confirmed by experiment that the relationship shown in Table 1 below makes it possible to reduce the magnitude of the stress at the first end 60*a*.

TABLE 1

| Wx [nm] | Wx [nm] | θ1 |
|---|---|---|
| 50 | 106.7 | 169.8 |
| 100 | 184.5 | 170.0 |
| 150 | 254.2 | 170.3 |
| 200 | 319.1 | 170.5 |
| 250 | 380.6 | 170.7 |
| 300 | 439.6 | 170.9 |
| 400 | 496.5 | 171.1 |

The above experiment revealed that there is the following relationship expressed by Formula 7 between the width Wx and the width Wz.

$$Wz=4.8541Wx^{(-0.79)} \quad \text{Formula 7}$$

In addition, there is the following relationship expressed by Formula 8 between the angle θ1 and the width Wx.

$$\theta 1=0.0042Wx+169.65 \quad \text{Formula 8}$$

B: Second Embodiment

Figure 9:
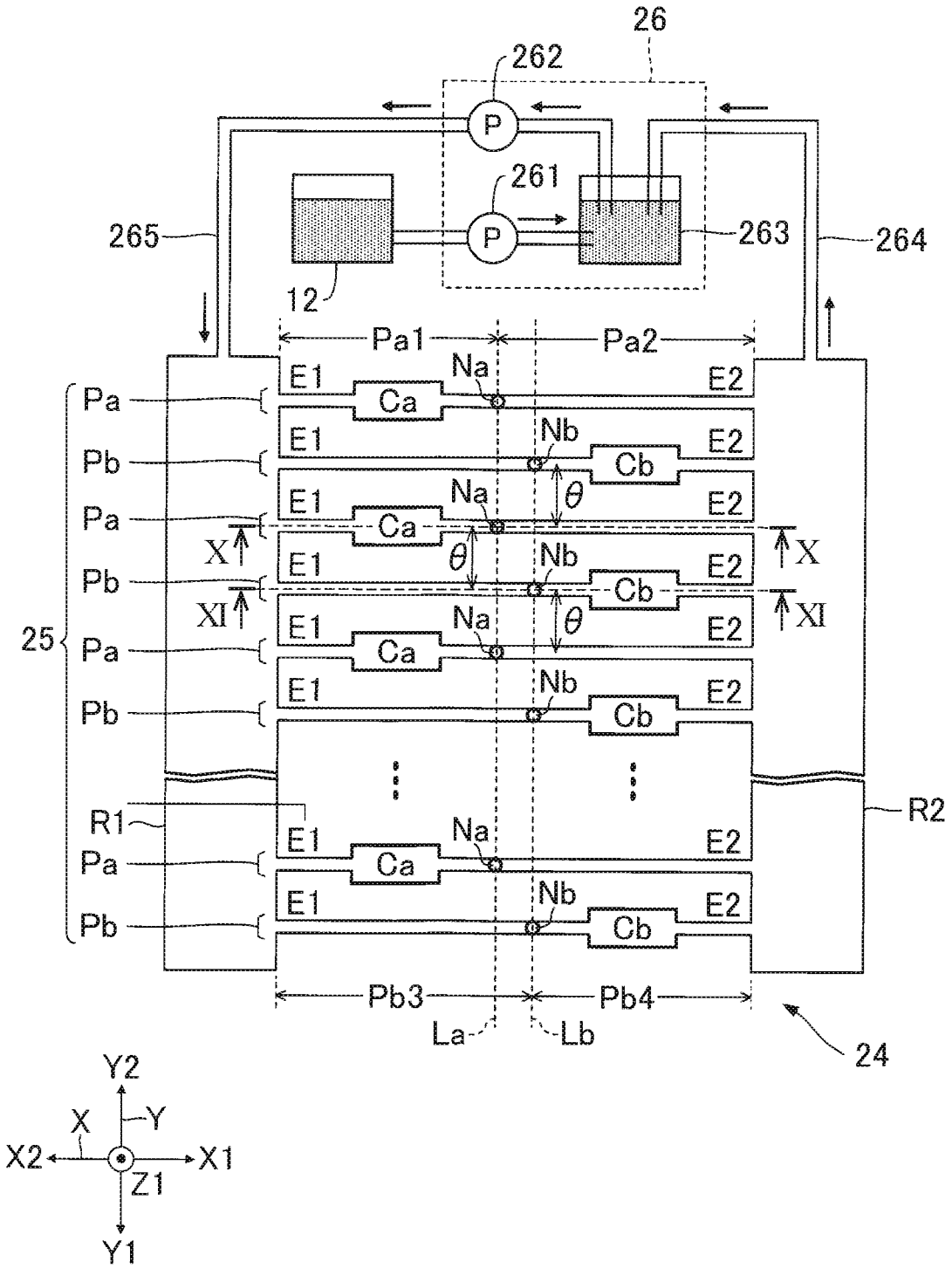
FIG. 9 is a schematic view of a passage structure inside a liquid ejecting head according to a second embodiment.

FIG. 9 is a schematic view of a passage structure inside a liquid ejecting head 24 according to a second embodiment when the liquid ejecting head 24 is viewed in the Z-axis direction. The liquid ejecting head 24 has a surface facing a medium 11, and, in this surface, a plurality of nozzles N (Na, Nb) is formed as illustrated in FIG. 9. The nozzles N are arranged along the Y axis. Ink is ejected from each of the plurality of nozzles N in the Z-axis direction. That is, the Z-axis direction corresponds to the direction in which ink is ejected from each of the plurality of nozzles N.

The plurality of nozzles N according to the second embodiment is grouped into a first linear nozzle array La and a second linear nozzle array Lb. The first linear nozzle array La is a collective name for the group of nozzles Na arranged in a line along the Y axis. Similarly, the second linear nozzle array Lb is a collective name for the group of nozzles Nb arranged in a line along the Y axis. The first linear nozzle array La and the second linear nozzle array Lb are arranged to form lines adjacent to each other, with a predetermined clearance being present in the X-axis direction. The respective positions of the nozzles Na in the Y-axis direction are different from the respective positions of the nozzles Nb in the Y-axis direction. As illustrated in FIG. 9, the plural nozzles N including the nozzles Na and the nozzles Nb are arranged at a pitch (cycle) of θ. The pitch θ is a distance between the center of the nozzle Na and the center of the nozzle Nb in the Y-axis direction.

As illustrated in FIG. 9, individual passage rows 25 are provided in the liquid ejecting head 24. The term "individual passage rows 25" is collectively used for a plurality of individual passages P (Pa, Pb) corresponding to the respective nozzles N different from one another. Each of the plurality of individual passages P is a passage that is in communication with the nozzle N corresponding to this one of the individual passages P. Each of the plurality of individual passages P extends along the X axis. The individual passage rows 25 are constituted of the plurality of individual passages P arranged next to one another along the Y axis. Although each of the plurality of individual passages P is illustrated as a simple straight line for convenience's sake in FIG. 9, the actual shape of each of the plurality of individual passages P will be described later.

Each of the plurality of individual passages P includes a pressure compartment C (Ca, Cb). The pressure compartment C of each of the plurality of individual passages P is a space inside which ink that is to be ejected from the nozzle N that is in communication with this individual passage P is contained. That is, ink is ejected from the nozzle N as a result of a change in pressure of ink inside the pressure compartment C. The pressure compartment C according to the second embodiment has the same structure as that of the pressure compartment C according to the first embodiment, which has been explained with reference to FIGS. 5 to 8. Therefore, the liquid ejecting head 24 according to the second embodiment makes it possible to reduce the magnitude of the stress at the first end 60*a*, similarly to the liquid ejecting head 24 according to the first embodiment. For this reason, the liquid ejecting head 24 according to the second embodiment offers improved durability.

As illustrated in FIG. 9, a first common liquid reservoir R1 and a second common liquid reservoir R2 are provided in the liquid ejecting head 24. Each of the first common liquid reservoir R1 and the second common liquid reservoir R2 extends in the Y-axis direction throughout the entire range of presence of the plurality of nozzles N. In a plan view along the Z1 direction, the individual passage rows 25 and the nozzles N are located between the first common liquid reservoir R1 and the second common liquid reservoir R2.

The plurality of individual passages P is connected in common to the first common liquid reservoir R1. Specifically, an end portion E1, which is located at the X2-directional end, of each of the plurality of individual passages P is connected to the first common liquid reservoir R1. The plurality of individual passages P is connected in common to the second common liquid reservoir R2. Specifically, an end portion E2, which is located at the X1-directional end, of each of the plurality of individual passages P is connected to the second common liquid reservoir R2. As will be understood from the above explanation, the first common liquid reservoir R1 and the second common liquid reservoir R2 are in communication with each other through each of the plurality of individual passages P. Ink that is supplied from the first common liquid reservoir R1 to each of the plurality of individual passages P is ejected from the nozzle N corresponding to this one of the individual passages P. Of the ink that is supplied from the first common liquid reservoir R1 to each of the plurality of individual passages P, a part that is not ejected from the corresponding nozzle N is discharged into the second common liquid reservoir R2.

As illustrated in FIG. 9, the liquid ejecting head 24 according to the second embodiment includes a circulation mechanism 26. The circulation mechanism 26 is a mechanism that causes the ink discharged from each of the plurality of individual passages P into the second common liquid reservoir R2 to flow back into the first common liquid reservoir R1. Specifically, the circulation mechanism 26 includes a first supply pump 261, a second supply pump 262, a pooling container 263, a circulation passage 264, and a supply passage 265.

The first supply pump 261 is a pump that supplies ink contained in a liquid container 12 to the pooling container 263. The pooling container 263 is a sub tank that temporarily contains the ink supplied from the liquid container 12. The circulation passage 264 is a passage through which the second common liquid reservoir R2 is in communication with the pooling container 263. The ink contained in the liquid container 12 is supplied to the pooling container 263 by the first supply pump 261. In addition, the ink discharged into the second common liquid reservoir R2 from each of the plurality of individual passages P is supplied through the circulation passage 264 to the pooling container 263. The second supply pump 262 is a pump that sends out the ink pooled in the pooling container 263. The ink sent out from the second supply pump 262 is supplied through the supply passage 265 into the first common liquid reservoir R1.

The plurality of individual passages P constituting the individual passage rows 25 includes a plurality of individual passages Pa and a plurality of individual passages Pb. Each of the plurality of individual passages Pa is an individual passage P that is in communication with one nozzle Na among those of the first linear nozzle array La. Each of the plurality of individual passages Pb is an individual passage P that is in communication with one nozzle Nb among those of the second linear nozzle array Lb. The individual passages Pa and the individual passages Pb are arranged alternately in the Y-axis direction. That is, the individual passage Pa and the individual passage Pb are adjacent to each other in the Y-axis direction.

As will be understood from the above explanation, the plural pressure compartments Ca, which correspond to the respective nozzles Na different from one another and belonging to the first linear nozzle array La, are arranged to form a linear array in the Y-axis direction. Similarly, the plural pressure compartments Cb, which correspond to the respective nozzles Nb different from one another and belonging to the second linear nozzle array Lb, are arranged to form a linear array in the Y-axis direction. The array made up of the plurality of pressure compartments Ca and the array made up of the plurality of pressure compartments Cb are provided in two columns, with a predetermined distance therebetween in the X-axis direction. The respective positions of the pressure compartments Ca in the Y-axis direction are different from the respective positions of the pressure compartments Cb in the Y-axis direction.

Figure 10:
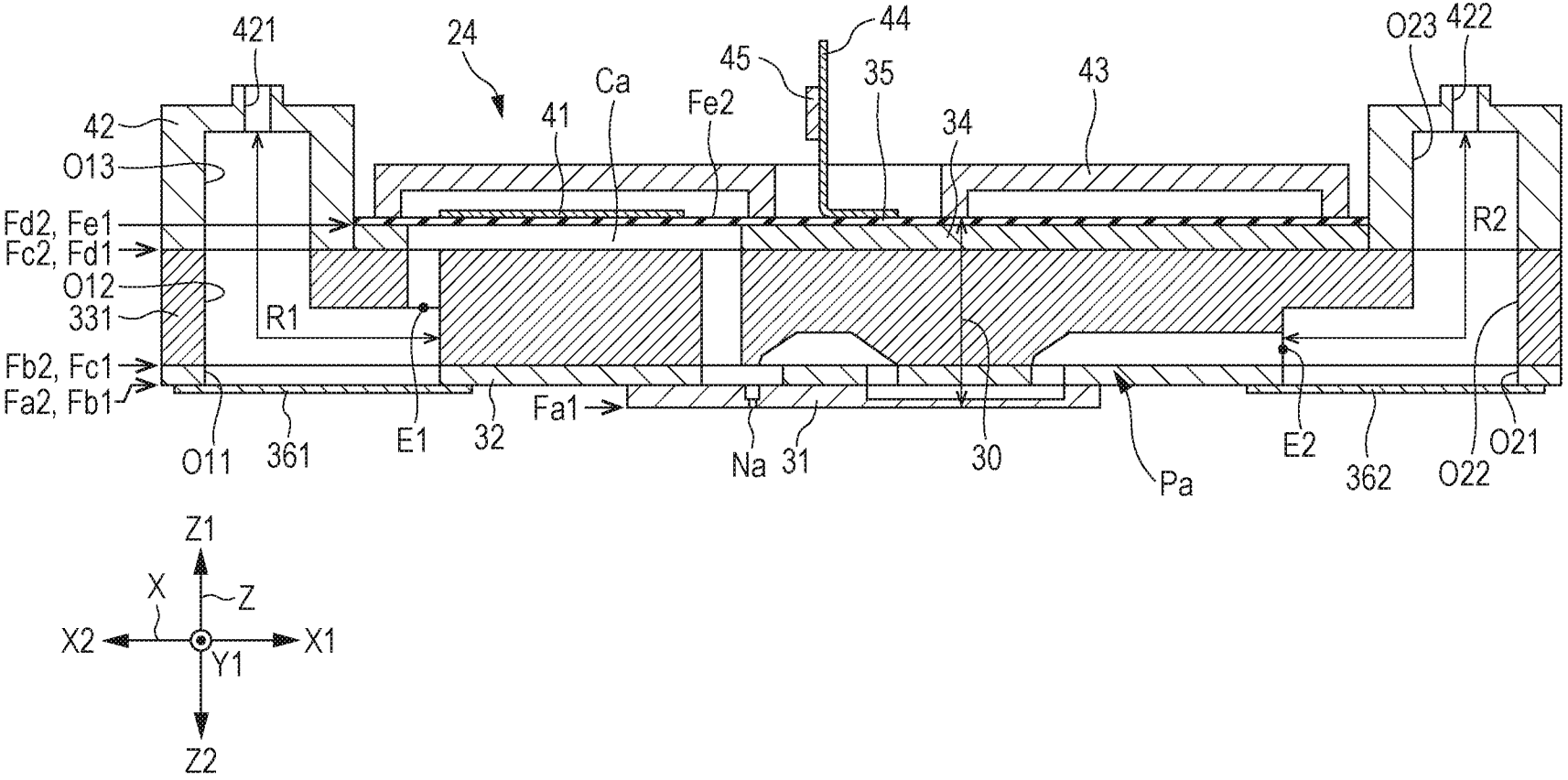
FIG. 10 is a sectional view taken along the line X-X of FIG. 9.
Figure 11:
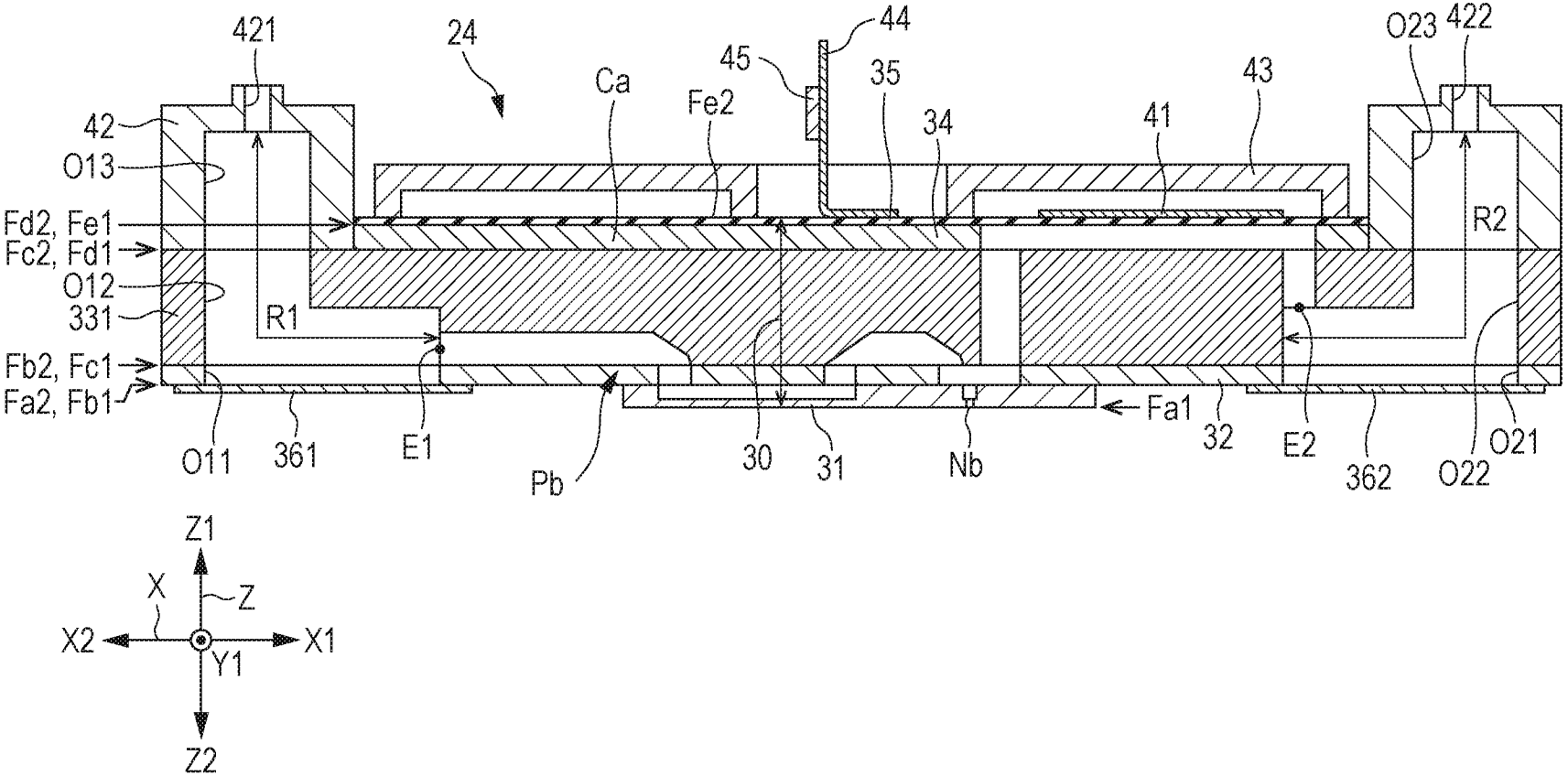
FIG. 11 is a sectional view taken along the line XI-XI of FIG. 9.

A specific structure of the liquid ejecting head 24 will now be explained in detail. FIG. 10 is a sectional view taken along the line X-X of FIG. 9. FIG. 11 is a sectional view taken along the line XI-XI of FIG. 9. FIG. 10 shows a cross section passing through the individual passage Pa. FIG. 11 shows a cross section passing through the individual passage Pb.

As illustrated in FIGS. 10 and 11, the liquid ejecting head 24 includes a passage structure stack 30, a plurality of piezoelectric elements 41, a casing portion 42, a protection substrate 43, and a wiring substrate 44. The passage structure stack 30 is a structure member inside which passages are formed, including the first common liquid reservoir R1, the second common liquid reservoir R2, the plurality of individual passages P, and the plurality of nozzles N.

The passage structure stack 30 has a structure in which a nozzle plate 31, a first passage substrate 32, a second passage substrate 331, a pressure compartment substrate 34, and a vibrating plate 35 are stacked in this order as viewed in the Z1 direction. These components that constitute the passage structure stack 30 are manufactured by, for example, processing a monocrystalline silicon substrate by using a semiconductor manufacturing technology.

The plurality of nozzles N is formed in the nozzle plate 31. Each of the plurality of nozzles N is a circular through hole through which ink passes. The nozzle plate 31 according to the second embodiment is a plate-shaped member that has a surface Fa1 located in the Z2 direction and a surface Fat located in the Z1 direction.

The first passage substrate 32 illustrated in FIGS. 10 and 11 is a plate-shaped member that has a surface Fb1 located in the Z2 direction and a surface Fb2 located in the Z1 direction. The second passage substrate 331 is a plate-shaped member that has a surface Fc1 located in the Z2 direction and a surface Fc2 located in the Z1 direction. The second passage substrate 331 is thicker than the first passage substrate 32.

The pressure compartment substrate 34 is a plate-shaped member that has a surface Fd1 located in the Z2 direction and a surface Fd2 located in the Z1 direction. The vibrating plate 35 is a plate-shaped member that has a surface Fe1 located in the Z2 direction and a surface Fe2 located in the Z1 direction.

Each of the components that constitute the passage structure stack 30 has a rectangular shape that is relatively long in the Y-axis direction. These components are bonded to one another by using, for example, an adhesive. For example, the surface Fat of the nozzle plate 31 is bonded to the surface Fb1 of the first passage substrate 32. The surface Fb2 of the first passage substrate 32 is bonded to the surface Fc1 of the second passage substrate 331. The surface Fc2 of the second passage substrate 331 is bonded to the surface Fd1 of the pressure compartment substrate 34. The surface Fd2 of the pressure compartment substrate 34 is bonded to the surface Fe1 of the vibrating plate 35.

A space O11 and a space O21 are formed in the first passage substrate 32. Each of the space O11 and the space O21 is an opening that is elongated in the Y-axis direction. A space O12 and a space O22 are formed in the second passage substrate 331. Each of the space O12 and the space O22 is an opening that is elongated in the Y-axis direction. The space O11 and the space O12 are in communication with each other. Similarly, the space O21 and the space O22 are in communication with each other. A vibration absorbing member 361, with which the space O11 is closed, and a vibration absorbing member 362, with which the space O21 is closed, are provided on the surface Fb1 of the first passage substrate 32. Each of the vibration absorbing member 361 and the vibration absorbing member 362 is a membranous member made of an elastic material.

The casing portion 42 is a case for containing ink. The casing portion 42 is bonded to the surface Fc2 of the second passage substrate 331. A space O13, which is in communication with the space O12, and a space O23, which is in communication with the space O22, are formed in the casing portion 42. Each of the space O13 and the space O23 is a space that is elongated in the Y-axis direction. The space O11, the space O12, and the space O13 constitute the first common liquid reservoir R1 by being in communication with one another. Similarly, the space O21, the space O22, and the space O23 constitute the second common liquid reservoir R2 by being in communication with one another. The vibration absorbing member 361 constitutes the floor of the first common liquid reservoir R1 and absorbs the pressure fluctuations of ink inside the first common liquid reservoir R1. The vibration absorbing member 362 constitutes the floor of the second common liquid reservoir R2 and absorbs the pressure fluctuations of ink inside the second common liquid reservoir R2.

A supply inlet 421 and a discharge outlet 422 are formed in the casing portion 42. The supply inlet 421 is a conduit that is in communication with the first common liquid reservoir R1. The supply inlet 421 is connected to the supply passage 265 of the circulation mechanism 26. The ink sent out from the second supply pump 262 to the supply passage 265 flows through the supply inlet 421 to be supplied to the first common liquid reservoir R1. The other, the discharge outlet 422, is a conduit that is in communication with the second common liquid reservoir R2. The discharge outlet 422 is connected to the circulation passage 264 of the circulation mechanism 26. Ink inside the second common liquid reservoir R2 is supplied to the circulation passage 264 through the discharge outlet 422.

A plurality of pressure compartments C (Ca, Cb) is formed in the pressure compartment substrate 34. Each of the plurality of pressure compartments C is a gap between the surface Fc2 of the second passage substrate 331 and the surface Fe1 of the vibrating plate 35. In a plan view along the Z1 direction, each of the plurality of pressure compartments C has an elongated shape along the X axis.

The vibrating plate 35 is a plate-shaped member that is able to vibrate elastically. The vibrating plate 35 has a multiple-layer structure made up of, for example, a first layer of silicon oxide ($SiO_2$) and a second layer of zirconium oxide ($ZrO_2$). The vibrating plate 35 and the pressure compartment substrate 34 may be formed integrally by selectively removing a part, in the thickness direction, of an area corresponding to the pressure compartment C in a plate-shaped member that has a predetermined thickness. The vibrating plate 35 may have a single-layer structure.

The piezoelectric elements 41 corresponding to the respective pressure compartments C different from one another are provided on the surface Fe2 of the vibrating plate 35. The piezoelectric elements 41 corresponding to the respective pressure compartments C overlap with the respective pressure compartments C in a plan view along the Z1 direction. Specifically, each of the plurality of piezoelectric elements 41 has a layered structure made up of a first electrode and a second electrode being the opposite of each other and a piezoelectric substance layer formed between these two electrodes. Each of the plurality of piezoelectric elements 41 is an energy generation element for ejecting ink inside the corresponding pressure compartment C from the corresponding nozzle N by changing the pressure of the ink inside the corresponding pressure compartment C. Specifically, the piezoelectric element 41 deforms when a drive signal is supplied, and the deformation causes the vibrating plate 35 to vibrate. Since the pressure compartment C expands and contracts due to the vibration of the vibrating plate 3, ink is ejected. The pressure compartments C (Ca, Cb) are compartmentalized each as a range in the individual passage P at which the vibrating plate 35 vibrates due to the deformation of the piezoelectric element 41.

The protection substrate 43 is a plate-type member provided on the surface Fe2 of the vibrating plate 35. The protection substrate 43 protects the plurality of piezoelectric elements 41 and reinforces the mechanical strength of the vibrating plate 35. The plurality of piezoelectric elements 41 is housed between the protection substrate 43 and the vibrating plate 35. The wiring substrate 44 is mounted on the surface Fe2 of the vibrating plate 35. The wiring substrate 44 is a mounted component that provides electric connection between the control unit 21 and the liquid ejecting head 24. For example, a flexible wiring board such as FPC (Flexible Printed Circuit) or FFC (Flexible Flat Cable) may be preferably used as the wiring substrate 44. A drive circuit 45 for supplying a drive signal to each piezoelectric element 41 is mounted on the wiring substrate 44.

C: Other Embodiments

The structure of the liquid ejecting head 24 is not limited to the examples described and illustrated in the foregoing first and second embodiments. The liquid ejecting head 24 may have a structure obtained by combining any two or more examples selected from among the examples disclosed in the foregoing first and second embodiments as long as the selected two or more examples are not contradictory to each other or one another.

D: Variation Examples

Although some exemplary embodiments of the present disclosure have been described above, the scope of the present disclosure is not limited to the foregoing embodiments, and various modifications may be made to them. Some specific examples of modifications that may be made to the foregoing exemplary modes are described below. Any two or more examples selected from among those disclosed below may be combined as long as the selected two or more examples are not contradictory to each other or one another.

(1) In the foregoing embodiments, some examples of a structure in which ink is circulated from the second common liquid reservoir R2 back to the first common liquid reservoir R1 have been described. However, depending on the needs, the technical concept of circulating ink may be omitted. Therefore, depending on the needs, the second common liquid reservoir R2 and the circulation mechanism 26 may be omitted.

(2) The energy generation element that changes the pressure of ink inside the pressure compartment C is not limited to the piezoelectric element 41 disclosed as an example in the foregoing embodiments. For example, a heat generation element that changes the pressure of ink by producing air bubbles inside the pressure compartment C by heating may be used as the energy generation element. In a structure in which heat generation elements are used as the energy generation elements, the pressure compartments C are compartmentalized each as a range in the individual passage P at which air bubbles are produced due to heating by the heat generation element.

(3) In the foregoing embodiments, a serial-type liquid ejecting apparatus 100 that reciprocates the traveler 231 on which the liquid ejecting head(s) 24 is mounted is disclosed as an example. However, the disclosed technique may be applied to a line-type liquid ejecting apparatus in which plural nozzles N are arranged throughout the entire width of the medium 11.

(4) In the foregoing embodiments, the width Wz of the curved portion 62 in the Z1 direction may be configured to be greater than the width Wx of the curved portion 62 in the X1 direction. When configured in this way, the first wall surface 3Aa may be not inclined with respect to the first surface 3A, and the first surface 3A and the first wall surface 3Aa may be included in the same plane. The magnitude of the stress at the first end 60*a* is reduced if the width Wz is greater than the width Wx.

(5) In the foregoing embodiments, the radius of curvature of the first portion 621 may be configured to be larger than the radius of curvature of the second portion 622. When configured in this way, the first wall surface 3Aa may be not inclined with respect to the first surface 3A, and the first surface 3A and the first wall surface 3Aa may be included in the same plane. The magnitude of the stress at the first end 60*a* is reduced if the radius of curvature of the first portion 621 is larger than the radius of curvature of the second portion 622.

E: Supplementary Description

The structure of the liquid ejecting apparatus 100 is not limited to the structure illustrated in FIGS. 1 to 11. For example, the disclosed features may be applied to a general liquid ejecting apparatus that circulates ink and has a structure other than the structure examples illustrated in these figures. Moreover, the liquid ejecting apparatus 100 disclosed as examples in the foregoing embodiments may be applied to various kinds of equipment such as facsimiles and copiers, etc. in addition to print-only machines. The uses and applications of the present disclosure are not specifically limited. In particular, the liquid ejecting apparatus is not limited to be used for printing. For example, a liquid ejecting apparatus that ejects a colorant solution can be used as an apparatus for manufacturing a color filter of a display device such as a liquid crystal display. A liquid ejecting apparatus that ejects a solution of a conductive material can be used as a manufacturing apparatus for forming wiring lines and electrodes of a wiring substrate. A liquid ejecting apparatus that ejects a solution of a living organic material can be used as, for example, a manufacturing apparatus for production of biochips.

In addition, the effects described in this specification are just for the purpose of explanation or showing examples and thus shall not be construed restrictively. That is, the present disclosure could produce, in addition to the effects disclosed above or in place of the effects disclosed above, other effects that are apparent to those skilled in the art from the description in this specification.

Although some exemplary embodiments of the present disclosure, including some non-limiting advantageous examples, have been described above, the scope of the present disclosure is not limited to these examples. It is evident that a person skilled in the technical field of the present disclosure will be able to arrive at an idea of various kinds of a variation example or a modification example within the scope of the technical concept recited in the appended claims. It should be understood as a matter of course that such variations and modifications are also within the technical scope of the present disclosure.

F: Additional Notes

From the examples described above, for example, the following structure can be understood.

When it is stated in this specification that a component A overlaps with a component B when viewed in a particular direction, this statement means that at least a part of the component A and at least a part of the component B overlap with each other in a view along this direction. It is unnecessary that a whole of the component A and a whole of the component B overlap with each other. The statement "a component A overlaps with a component B" should be interpreted to be true as long as at least a part of the component A overlaps with at least a part of the component B.

A liquid ejecting head according to a first mode, which is one of aspects of the present disclosure, includes: an energy generation element that generates energy for applying pressure to liquid inside a pressure compartment; a vibrating plate that vibrates due to the energy; and a pressure compartment substrate that includes a first surface, which is in contact with a part of a bottom surface of the vibrating plate, and a first wall surface, which is continuous from the first surface, wherein a recessed portion that includes a bottom portion and a curved portion surrounding the bottom portion is provided in the bottom surface of the vibrating plate, the curved portion is provided from an end of the bottom portion to an end of the recessed portion and has a curved surface shape, a plurality of wall surfaces that constitute inner walls of the pressure compartment includes a surface of the recessed portion and the first wall surface, and an angle formed by the first surface and the first wall surface is greater than 90° and less than 180°. Since this mode makes it possible to reduce the magnitude of the stress at the boundary between the first surface and the first wall surface, the durability of the liquid ejecting head improves.

In a second mode, which is a specific example of the first mode, the angle formed by the first surface and the first wall surface is greater than 150° and less than 180°. This mode makes it possible to improve the durability of the liquid ejecting head and reduce a structural crosstalk.

In a third mode, which is a specific example of the first mode or the second mode, the vibrating plate extends in a first direction, and a width of the curved portion in the first direction is less than a width of the curved portion in a second direction perpendicular to the vibrating plate.

In a fourth mode, which is a specific example of any of the first mode to the third mode, the curved portion includes a first portion, which includes a boundary between the pressure compartment substrate and the curved portion, and a second portion, which includes a boundary between the bottom portion and the curved portion, and a radius of curvature of the first portion is larger than a radius of curvature of the second portion. This mode makes it possible to reduce the magnitude of the stress at the boundary between the first surface and the first wall surface and reduce the width of the curved portion in the first direction. Therefore, it is possible to improve the durability of the liquid ejecting head and prevent problems that could occur in the manufacturing processes of the vibrating plate.

In a fifth mode, which is a specific example of any of the first mode to the fourth mode, a radius of curvature of the curved surface is 150 nm or less.

In a sixth mode, which is a specific example of any of the first mode to the fifth mode, the pressure compartment substrate includes a second wall surface continuous from the first wall surface, the plurality of wall surfaces that constitute the inner walls of the pressure compartment includes the second wall surface, and an angle formed by the first wall surface and the second wall surface is substantially equal to an angle obtained by subtracting the angle formed by the first surface and the first wall surface from 270°.

In a seventh mode, which is a specific example of the sixth mode, the vibrating plate extends in a first direction, and when the recessed portion is viewed in a second direction perpendicular to the vibrating plate, a position of a boundary between the bottom portion and the curved portion in the first direction is substantially the same as a position of the second wall surface in the first direction.

In an eighth mode, which is a specific example of any of the first mode to the seventh mode, the vibrating plate extends in a first direction, the pressure compartment substrate includes a second surface, which is in contact with a part of the bottom surface of the vibrating plate, and a third wall surface, which is continuous from the second surface, a position of the second surface in a second direction perpendicular to the vibrating plate is substantially the same as a position of the first surface in the second direction, the third wall surface faces the first wall surface in the first direction, and an angle formed by the second surface and the third wall surface is substantially the same as the angle formed by the first surface and the first wall surface.

In a ninth mode, which is a specific example of the eighth mode, the pressure compartment substrate includes a second wall surface, which is continuous from the first wall surface, and a fourth wall surface, which is continuous from the third wall surface, the plurality of wall surfaces that constitute the inner walls of the pressure compartment includes the fourth wall surface, and an angle formed by the third wall surface and the fourth wall surface is substantially equal to an angle formed by the first wall surface and the second wall surface. In this mode, since the angle formed by the second surface and the third wall surface is equal to the angle formed by the first surface and the first wall surface, the stress acting on the boundary the second surface and the third wall surface is substantially equal to the stress acting on the boundary the first surface and the first wall surface. Therefore, the durability of the liquid ejecting head improves.

In a tenth mode, which is a specific example of any of the first mode to the ninth mode, the pressure compartment substrate is made of silicon, and at least a part of the vibrating plate is made of silicon oxide.

A liquid ejecting apparatus according to an eleventh mode, which is one of aspects of the present disclosure, includes: the liquid ejecting head according to any of the first mode to the tenth mode; and a controller that controls operation of ejection from the liquid ejecting head.

What is claimed is:

1. A liquid ejecting head, comprising:

an energy generation element that generates energy for applying pressure to liquid inside a pressure compartment;

a vibrating plate that vibrates due to the energy; and a pressure compartment substrate that includes a first surface, which is in contact with a part of a bottom surface of the vibrating plate, and a first wall surface, which is continuous from the first surface, the first wall surface comprising an inclined surface that extends away from the vibration plate toward the pressure compartment, wherein a recessed portion that includes a bottom portion and a curved portion surrounding the bottom portion is provided in the bottom surface of the vibrating plate, the curved portion is provided from an end of the bottom portion to an end of the recessed portion and has a curved surface shape, a plurality of wall surfaces that constitute inner walls of the pressure compartment includes a surface of the recessed portion and the first wall surface, and an angle formed by the first surface and the first wall surface is greater than 90° and less than 180° due to the inclined surface of the first wall surface.

2. The liquid ejecting head according to claim 1, wherein the angle formed by the first surface and the first wall surface is greater than 150° and less than 180°.

3. The liquid ejecting head according to claim 1, wherein the vibrating plate extends in a first direction, and a width of the curved portion in the first direction is less than a width of the curved portion in a second direction perpendicular to the vibrating plate.

4. The liquid ejecting head according to claim 1, wherein the curved portion includes a first portion, which includes a boundary between the pressure compartment substrate and the curved portion, and a second portion, which includes a boundary between the bottom portion and the curved portion, and a radius of curvature of the first portion is larger than a radius of curvature of the second portion.

5. The liquid ejecting head according to claim 1, wherein a radius of curvature of the curved surface is 150 nm or less.

6. The liquid ejecting head according to claim 1, wherein the pressure compartment substrate includes a second wall surface continuous from the first wall surface, the plurality of wall surfaces that constitute the inner walls of the pressure compartment includes the second wall surface, and an angle formed by the first wall surface and the second wall surface is substantially equal to an angle obtained by subtracting the angle formed by the first surface and the first wall surface from 270°.

7. The liquid ejecting head according to claim 6, wherein the vibrating plate extends in a first direction, and when the recessed portion is viewed in a second direction perpendicular to the vibrating plate, a position of a boundary between the bottom portion and the curved portion in the first direction is substantially the same as a position of the second wall surface in the first direction.

8. The liquid ejecting head according to claim 1, wherein the vibrating plate extends in a first direction, the pressure compartment substrate includes a second surface, which is in contact with a part of the bottom surface of the vibrating plate, and a third wall surface, which is continuous from the second surface, a position of the second surface in a second direction perpendicular to the vibrating plate is substantially the same as a position of the first surface in the second direction, the third wall surface faces the first wall surface in the first direction, and an angle formed by the second surface and the third wall surface is substantially the same as the angle formed by the first surface and the first wall surface.

9. The liquid ejecting head according to claim 8, wherein the pressure compartment substrate includes a second wall surface, which is continuous from the first wall surface, and a fourth wall surface, which is continuous from the third wall surface, the plurality of wall surfaces that constitute the inner walls of the pressure compartment includes the fourth wall surface, and an angle formed by the third wall surface and the fourth wall surface is substantially equal to an angle formed by the first wall surface and the second wall surface.

10. The liquid ejecting head according to claim 1, wherein the pressure compartment substrate is made of silicon, and at least a part of the vibrating plate is made of silicon oxide.

11. A liquid ejecting apparatus, comprising:

the liquid ejecting head according to claim 1; and a controller that controls operation of ejection from the liquid ejecting head.

* * * * *